US008847841B2

(12) United States Patent
Oota et al.

(10) Patent No.: US 8,847,841 B2
(45) Date of Patent: Sep. 30, 2014

(54) MULTI-BEAM ANTENNA DEVICE

(75) Inventors: Masahiko Oota, Chikusei (JP); Taketo Nomura, Chikusei (JP)

(73) Assignee: Hitachi Chemical Company, Ltd., Tokyo (JP)

( * ) Notice: Subject to any disclaimer, the term of this patent is extended or adjusted under 35 U.S.C. 154(b) by 648 days.

(21) Appl. No.: 13/146,961

(22) PCT Filed: Jan. 29, 2010

(86) PCT No.: PCT/JP2010/051273
§ 371 (c)(1),
(2), (4) Date: Jul. 29, 2011

(87) PCT Pub. No.: WO2010/087453
PCT Pub. Date: Aug. 5, 2010

(65) Prior Publication Data

US 2011/0285598 A1 Nov. 24, 2011

(30) Foreign Application Priority Data

Jan. 29, 2009 (JP) ..... 2009-018320
Jan. 29, 2010 (JP) ..... 2010-018219

(51) Int. Cl.
*H01Q 21/29* (2006.01)

(52) U.S. Cl.
USPC ..... 343/833

(58) Field of Classification Search
USPC ..... 343/833
See application file for complete search history.

(56) References Cited

U.S. PATENT DOCUMENTS 5,510,803 A 4/1996 Ishizaka et al.
6,160,519 A 12/2000 Hemmi
(Continued)

FOREIGN PATENT DOCUMENTS

CN 101291017 A 10/2008
JP 57-093701 6/1982
(Continued)

OTHER PUBLICATIONS

Korean Decision to grant dated May 20, 2013.
Chinese Official Action and Search Report dated Jun. 5, 2013.

*Primary Examiner* — Karl D Frech
(74) *Attorney, Agent, or Firm* — Antonelli, Terry, Stout & Kraus, LLP.

(57) ABSTRACT

Provided is a multi-beam antenna device capable of achieving two independent multi-beam characteristics using a single antenna unit, and enhanced gain. The multi-beam antenna device comprises a first antenna section, a second antenna section, a first Rotman lens section and a second Rotman lens section, which are laminated together in this order to form a planar antenna module. A first multi-beam characteristic is achieved by the first antenna section and the first Rotman lens section, and a second multi-beam characteristic is achieved by the second antenna section and the second Rotman lens section, independently. A Rotman lens in each of the Rotman lens sections is designed such that: $\beta$ with respect to $\alpha$ is set to satisfy the following relation: $\beta<\alpha$, where $\beta$ is a spatial beam-forming angle of an array antenna, and $\alpha$ is an elevation angle between a center line (208), and a line segment which connects one of an input port and an intersecting point S2; and a shape of a Rotman lens is set to satisfy the following relation: $\eta=(\beta/\alpha)\cdot(Ln/F)<1$, and reduce G to less than a basic value of G when designed under a defined condition of $\beta=\alpha$, where: F is a distance between the input port and S2; G is a size of the Rotman lens; and 2 Ln is the aperture length of an array antenna.

3 Claims, 16 Drawing Sheets

(56) References Cited

U.S. PATENT DOCUMENTS

| | | | |
|---|---|---|---|
| 6,720,931 | B1 | 4/2004 | Michisaka et al. |
| 7,411,553 | B2 | 8/2008 | Oota et al. |
| 8,253,511 | B2 | 8/2012 | Oota et al. |
| 2007/0229380 | A1 | 10/2007 | Oota et al. |
| 2008/0303721 | A1 | 12/2008 | Oota et al. |

FOREIGN PATENT DOCUMENTS

| | | | |
|---|---|---|---|
| JP | 05-152843 | | 6/1993 |
| JP | 2000-124727 | | 4/2000 |
| JP | 2002-523951 | | 7/2002 |
| JP | 3379969 | B2 | 12/2002 |
| KR | 100486831 | B1 | 4/2005 |
| KR | 100859638 | B1 | 8/2007 |
| WO | WO 01/80357 | | 10/2001 |

MULTI-BEAM ANTENNA DEVICE

TECHNICAL FIELD

The present invention relates to a configuration of a multi-beam antenna device utilizable for a vehicle-mounted millimeter-wave radar.

BACKGROUND ART

To begin with, a conventional multi-bean antenna device using a Rotman lens will be explained with its exploded perspective view illustrated in FIG. 11. In FIG. 11, the reference numeral (31) denotes a Rotman lens pattern whose details are illustrated in FIG. 12. In FIG. 12, the reference numerals (221), (222), - - - (22*m*) denote respective ones of a plurality of input ports for feeding electric power to a Rotman lens (1), and the reference numerals (231), (232), - - - (23*n*) denote respective ones of a plurality of output ports for extracting electric power in the Rotman lens (1). The reference numerals (241), (242), - - - (24*n*) denote respective ones of a plurality of antenna elements for radiating electromagnetic waves to space, and the reference numeral (205) denotes an array antenna having the plurality of antenna elements (241), (242), - - - (24*n*) arranged linearly. The reference numerals (261), (262), - - - (26*n*) denote respective ones of a plurality of feeder lines connecting respective ones of the output ports to respective ones of the antenna elements, and the reference numeral (207) denotes a line section comprised of the feeder lines (261), (262), (26*n*) having different lengths. The reference numeral (208) denotes a center line. This antenna device is line-symmetric with respect to the center line (208). The reference numeral (209) denotes an auxiliary line for indicating a position of one (221) of the input ports. The input port (221) is located in a direction at an elevation angle $\alpha$ with respect to the center line (208) when viewed from S2 which is an origin of an X-Y coordinate system. The reference numeral (210) denotes a straight line which is indicative of a spatial beam direction upon excitation of the input port (221), and oriented in a direction at an angle $\beta$ with respect to a direction facing a front of the array antenna. In a primitive or basic design process, a Rotman lens is generally designed under a condition of $\beta=\alpha$.

In the conventional antenna device configured as above, when one of the input ports (221), (222), - - - (22*m*) is excited, electric power is fed into the Rotman lens (201). The electric power in the Rotman lens (201) is extracted from each of the output ports (231), (232), - - - (223*n*), and transmitted to a corresponding one of the antenna elements (241), (242), - - - (24*n*) through a respective one of the feeder lines (261), (262), - - - (26*n*). Each of an excitation amplitude and an excitation phase of the array antenna (205) depends on which of the input ports (221), (222), - - - (22*m*) is excited, and the spatial beam direction depends on the excitation phase of the array antenna (205).

In the conventional Rotman lens pattern illustrated in FIG. 12, the input ports (221), (222), - - - (22*m*) are arranged on an arc having a radius R from a center located at a focal point S1 of the Rotman lens. The origin S2 of the X-Y coordinate system is represented by an intersecting point of the center line (208) with a curve segment having the output ports (231), (232), - - - , (23*n*) arranged thereon. S3 indicates an intersecting point of the center line (208) with a curve segment having the input ports (221), (222), - - - , (22*m*) arranged thereon. An x coordinate and a y coordinate of each of the output ports (331), (332), - - - (33*n*), and an electrical length w of each of the feeder lines (261), (262), - - - (26*n*), are expressed in the following Formulas 1 to 3, respectively:

$$x=[2w(1-g)-b_0^2\eta^2]/2(g-a_0) \quad (1)$$

$$y=\eta(1-w) \quad (2)$$

$$w=[-b-\sqrt{(b^2-4ac)}]/2a \quad (3)$$

In the above Formulas 1 to 3,
$g=G/F$, $\eta=Ln/F$, $a_0=\cos\alpha$, $b_0=\sin\alpha$,
$a=1-\eta^2-[(g-1)/(g-a_0)]^2$,
$b=2g(g-1)/(g-a_0)-[(g-1)/(g-a_0)^2]b_0^2\eta^2+2\eta^2-2g$, and
$c=gb_0^2\eta^2/(g-a_0)-b_0^4\eta^4/[4(g-a_0)^2]-\eta^2$.
Further, the radius R is expressed in the following formula:

$$R=[(Fa_0-G)^2+F^2b_0^2]/[2(G-Fa_0)] \quad (4)$$

In the Formula 4, G is a size of the Rotman lens defined by a distance between S2 and S3. Further, F is a distance between the input port (221) and S2, and 2 Ln is an aperture length of the array antenna (205). In the basic design process, it is commonly considered that it is desirable to set $\eta$ approximately in the following range: $0.8<\eta<1$, i.e., set F in a range of about 1 to 1.25 times Ln, and set g to about 1.137, under a defined condition of $\beta=\alpha$, in view of an advantage of being able to reduce an error in excitation phase at each of the output ports (231), (232), - - - (23*n*).

Meanwhile, as means for achieving a pencil beam antenna capable of radiating two orthogonally polarized waves in a single antenna unit, a structure formed by electromagnetically coupling two-layer triplate antennas as illustrated in FIG. 13 is considered to be effective.

PRIOR ART DOCUMENTS

Patent Documents

Patent Document 1: JP 57-93701A
Patent Document 2: JP 2000-124727A
Patent Document 3: JP 05-152843A

DISCLOSURE OF THE INVENTION

Problem to be Solved by the Invention

In the multi-beam antenna device for use in a vehicle-mounted radar, etc., a distant detection requires fine beam scanning in a relatively narrow angle range, and a proximal detection requires beam scanning in a relatively wide angle range. Thus, there has been an increasing need for performing such two functions independently. However, if two radar devices having different multi-beam characteristics are installed, problems, such as an increase in cost, and difficulty in ensuring an installation space, will occur.

Although FIG. 13 suggests a means for achieving a pencil beam antenna capable of radiating two orthogonally polarized waves using a single antenna unit, it dies not suggest a technique for achieving multi-beam characteristics. Moreover, any report on such achievement cannot be found.

Further, in the conventional multi-beam antenna device illustrated in FIG. 12, as a prerequisite to allowing the line section (207) to be configured, the radicand inside the radical symbol in the Formula 3 is required to have a positive sign or to be zero. In other words, the following Formula 5 has to be satisfied.

$$b^2-4ac\geq 0 \quad (5)$$

As a prerequisite to satisfying the Formula 5, $\eta=Ln/F$ has to be equal to or less than 1 ($\eta=Ln/F\leq 1$). This means that, in cases where the aperture 2 Ln of the array antenna (205) becomes larger due to an increase in the number of the antenna elements (241), (242), - - - (24*n*), it is necessary to increase the distance F between the input port (221) and S2 in proportion to the aperture 2 Ln of the array antenna (205), resulting in an increase in the size G of the Rotman lens. Therefore, when the number of the antenna elements (241), (242), - - - (24*n*) is increased, it is necessary to increase the size G of the Rotman lens in conformity to an increasing rate of the antenna elements, which causes a problem that, even though the number of the antenna elements is increased, an appropriate gain enhancement effect cannot be obtained.

The present invention is directed to providing a low-loss multi-beam antenna device capable of: achieving two independent multi-beam characteristics using a single antenna unit; and, under a condition that $\beta$ with respect to $\alpha$ is set to satisfy the following relation: $\beta<\alpha$, where: $\beta$ is a spatial beam-forming angle of an array antenna (205); and $\alpha$ is an angle between a center line (208) and a line segment which connects one of a plurality of input ports and an intersecting point S2 of the center line (208) with a curve segment having a plurality of output ports (231), (232), - - - , (23*n*) arranged thereon, reducing G which is a size of a Rotman lens, to less than a value of G set out through a basic design process, i.e., a basic value of G when designed under a defined condition of $\beta=\alpha$, and thereby suppressing an increase in loss of the Rotman lens so as to achieve enhanced gain.

Means for Solving the Problem

The present invention provides a multi-beam antenna device comprising a first antenna section (101), a second antenna section (102), a first Rotman lens section (103) and a second Rotman lens section (104), which are laminated together in this order to form a planar antenna module. The first antenna section (101) includes a first antenna substrate (4), a first ground conductor (6), a second ground conductor (9), a third ground conductor (13) and a fourth ground conductor (10), wherein: the first antenna substrate (4) has a plurality of first radiation elements (1) and a plurality of first parasitic elements (67), which are located at positions corresponding to respective ones of a plurality of second radiation elements (16) of the second antenna section (102), in such a manner that a plurality of antenna groups is formed therein in combination with a first feeder line (2) connected to the first radiation elements (1) and a first connection portion (3) electromagnetically coupled to the second Rotman lens section (104); the first ground conductor (6) has a plurality of first slots (5) located at positions corresponding to respective ones of the first radiation elements (1) and the first parasitic elements (67); the second ground conductor (9) has a first dielectric (7) located between the first antenna substrate (4) and the first ground conductor (6), and a first coupling hole-defining portion (8) located at a position corresponding to the first connection portion (3); the third ground conductor (13) has a second dielectric (11) located between the first antenna substrate (4) and the fourth ground conductor (10), and a second coupling hole-defining portion (12) located at a position corresponding to the first connection portion (3); and the fourth ground conductor (10) has a first slit (14) located at a position corresponding to the first connection portion (3), and a plurality of second slits (15) located at positions corresponding to the respective ones of the first radiation elements (1) and the first parasitic elements (67). The second antenna section (102) includes a second antenna substrate (19), the fourth ground conductor (10), a fifth ground conductor (23), a sixth ground conductor (28) and a seventh ground conductor (24), wherein: the second antenna substrate (19) has a plurality of antenna groups formed in combination with a second feeder line (17) connected to the second radiation elements (16) and a second connection portion (18) electromagnetically coupled to the first Rotman lens section (103); the fifth ground conductor (23) has a third dielectric (20) located between the second antenna substrate (19) and the fourth ground conductor (10), a third coupling hole-defining portion (21) located at a position corresponding to the second connection portion (18), and a third slit (22) located at a position corresponding to the first connection portion (3); the sixth ground conductor (28) has a fourth dielectric (25) located between the second antenna substrate (19) and the seventh ground conductor (24), a fourth coupling hole-defining portion (26) located at a position corresponding to the second connection portion (18), and a fourth slit (27) located at a position corresponding to the first connection portion (3); and the seventh ground conductor (24) has a fifth slit (29) located at a position corresponding to the second connection portion (18), and a sixth slit (30) located at positions corresponding to the first connection portion (3). The first Rotman lens section (103) includes a first Rotman lens substrate (37), the seventh ground conductor (24), an eighth ground conductor (42), a ninth ground conductor (47) and a tenth ground conductor (34), wherein: the first Rotman lens substrate (37) has a first Rotman lens (31), a third feeder line (32), a third connection portion (33) electromagnetically coupled to the second connection portion (18) of the second antenna section (102), and a fourth connection portion (36) electromagnetically coupled to a first waveguide opening portion (35) of the tenth ground conductor (34); the eighth ground conductor (42) has a fifth dielectric (38) located between the first Rotman lens substrate (37) and the seventh ground conductor (24), a fifth coupling hole-defining portion (39) located at a position corresponding to the third connection portion (33), a sixth coupling hole-defining portion (40) located at a position corresponding to the fourth connection portion (36), and a seventh slit (41) located at a position corresponding to the first connection portion (3); the ninth ground conductor (47) has a sixth dielectric (43) located between the first Rotman lens substrate (37) and the tenth ground conductor (34), a seventh coupling hole-defining portion (44) located at a position corresponding to the third connection portion (33), an eighth coupling hole-defining portion (45) located at a position corresponding to the fourth connection portion (36), and an eighth slit (46) located at a position corresponding to the first connection portion (3); and the tenth ground conductor (34) has the first waveguide opening portion (35) located at a position corresponding to the fourth connection portion (36), and a ninth slit (48) located at a position corresponding to the first connection portion (3). The second Rotman lens section (104) includes a second Rotman lens substrate (55), the tenth ground conductor (34), an eleventh ground conductor (60), a twelfth ground conductor (65) and a thirteenth ground conductor (52), wherein: the second Rotman lens substrate (55) has a second Rotman lens (49), a fourth feeder line (50), a fifth connection portion (51) electromagnetically coupled to the first connection portion (3) of the first antenna section (101), and a sixth connection portion (54) electromagnetically coupled to a second waveguide opening portion (53) of the thirteenth ground conductor (52); the eleventh ground conductor (60) has a seventh dielectric (56) located between the second Rotman lens substrate (55) and the tenth ground conductor (34), a ninth coupling hole-defining portion (57) located at a position corresponding to the fifth connection portion (51), a tenth coupling hole-defining portion (58) located at a position corresponding to the sixth connection portion (54), and a third waveguide opening portion (59) located at a position corresponding to the fourth connection portion (36); the twelfth ground conductor (65) has an eighth dielectric (61) located between the second Rotman lens substrate (55) and the thirteenth ground conductor (52), an eleventh coupling hole-defining portion (62) located at a position corresponding to the fifth connection portion (51), a twelfth coupling hole-defining portion (63) located at a position corresponding to the sixth connection portion (54), and a fourth waveguide opening portion (64) located at a position corresponding to the fourth connection portion (36); and the thirteenth ground conductor (52) has the second waveguide opening portion (53) located at a position corresponding to the sixth connection portion (54), and a fifth waveguide opening portion (66) located at a position corresponding to the fourth connection portion (36). In the multi-beam antenna device, the first ground conductor (6), the second ground conductor (9) with the first dielectric (7), the first antenna substrate (4), the third ground conductor (13) with the second dielectric (11), the fourth ground conductor (10), the fifth ground conductor (23) with the third dielectric (20), the second antenna substrate (19), the sixth ground conductor (28) with the fourth dielectric (25), the seventh ground conductor (24), the eighth ground conductor (42) with the fifth dielectric (38), the first Rotman lens substrate (37), the ninth ground conductor (47) with the sixth dielectric (43), the tenth ground conductor (34), the eleventh ground conductor (60) with the seventh dielectric (56), the second Rotman lens substrate (55), the twelfth ground conductor (65) with the eighth dielectric (61), and the thirteenth ground conductor (52), are laminated together in this order.

In the multi-beam antenna device of the present invention, at least one of the first to ninth slits may be formed as a slot.

In The multi-beam antenna of the present invention, each of the first and second Rotman lenses may be configured as illustrated in FIG. 7, and designed as follows: $\beta$ with respect to $\alpha$ is set to satisfy the following relation: $\beta<\alpha$, where: $\beta$ is a spatial beam-forming angle of an array antenna (205) when viewed from a direction facing a front of the array antenna; and $\alpha$ is an angle between a center line (208) of the Rotman lens, and a line segment which connects one of the input ports and an intersecting point S2 of the center line (208) with a curve segment having the output ports (231), (232), - - - , (23*n*) arranged thereon; and a shape of the Rotman lens is set to satisfy the following relation: $\eta=(\beta/\alpha)\cdot(Ln/F)<1$, and reduce G to less than a value of G when designed under a condition of $\beta=\alpha$, where: F is a distance between the one input port (221) and S2; 2 Ln is an aperture length of the array antenna; and G is a size of the Rotman lens, and defined as a distance between S2 and S3 (wherein S3 is an intersecting point of the center line (208) with a curve segment having the input ports (221), (222), - - - , (22*m*) arranged thereon).

Effect of the Invention

The present invention can provide a low-loss multi-beam antenna device capable of: achieving two independent multi-beam characteristics using a single antenna unit; and, under a condition that $\beta$ with respect to $\alpha$ is set to satisfy the following relation: $\beta<\alpha$, where: $\beta$ is a spatial beam-forming angle of an array antenna (205); and $\alpha$ is an angle between a center line (208) and a line segment which connects one of a plurality of input ports and an intersecting point S2 of the center line (208) with a curve segment having a plurality of output ports (231), (232), - - - , (23*n*) arranged thereon, reducing G which is a size of a Rotman lens, to less than a value of G set out through a basic design process, i.e., a basic value of G when designed under a defined condition of $\beta=\alpha$, and thereby suppressing an increase in loss of the Rotman lens so as to achieve enhanced gain.

DESCRIPTION OF EMBODIMENTS (First Embodiment)

Figure 1:
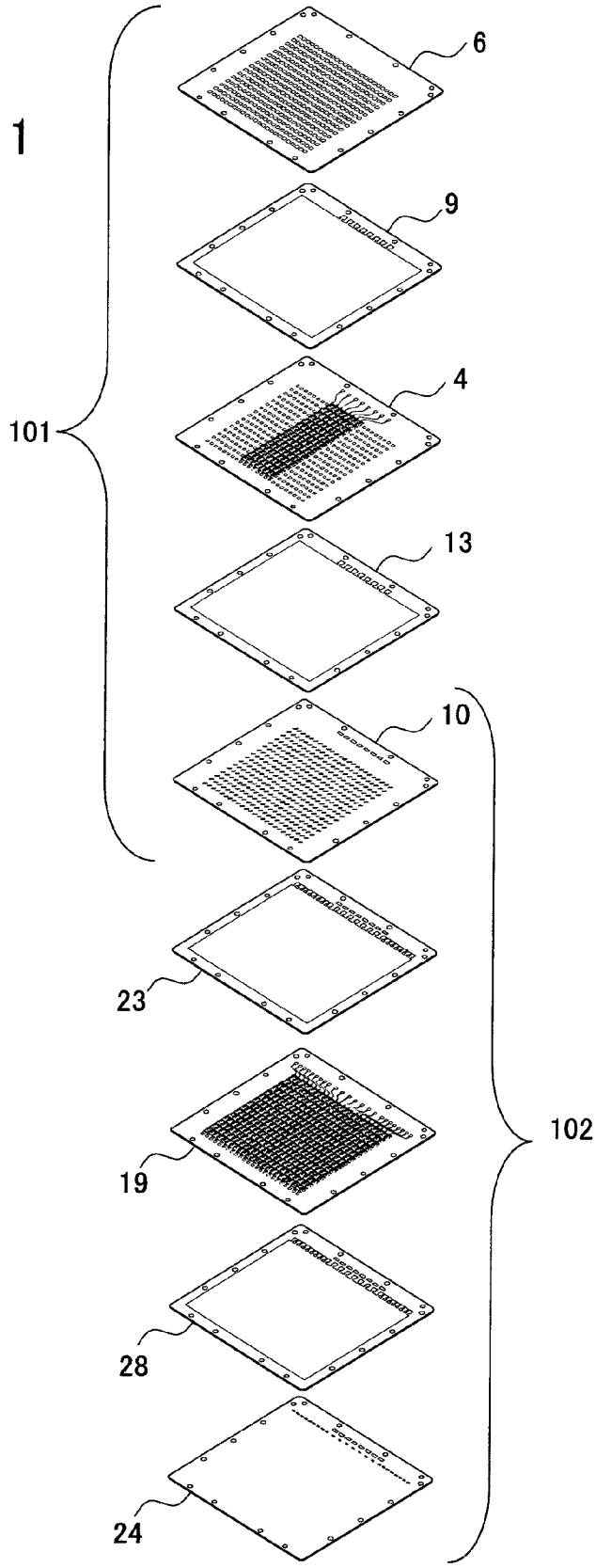
FIG. 1 is an explanatory diagram illustrating a first configuration of a multi-beam antenna device according to the present invention.

A multi-beam antenna according to the present invention is characterized in that: it is configured to achieve two independent multi-beam characteristics using a single antenna unit; and, under a condition that β with respect to α is set to satisfy the following relation: β<α, where: β is a spatial beam-forming angle of an array antenna (205); and α is an elevation angle between a center line (208), and a line segment which connects one of a plurality of input ports and an intersecting point S2 of the center line (208) with a curve segment having a plurality of output ports (231), (232), - - - , (23*n*) arranged thereon, a shape of a Rotman lens is set to satisfy the Formula 6, and reduce G to less than a basic value of G when designed under a defined condition of β=α, where: F is a distance between the one input port (221) and S2; G is a size of the Rotman lens, and defined as a distance between S2 and S3; and 2 Ln is an aperture length of the array antenna (205).

Specifically, in cases where a Rotman lens is designed under the defined condition of β=α, as a prerequisite to satisfying the Formula 5, η=Ln/F has to be equal to or less than 1 (η=Ln/F≤1). Further, it is generally considered that it is desirable to set η approximately in the following range: 0.8<η<1, i.e., set F in a range of about 1 to 1.25 times Ln, and set g to about 1.137, in view of an advantage of being able to reduce an error in excitation phase at each of the output ports (231), (232), - - - (23*n*). Thus, it is preferable to set F and G in the following respective ranges with respect to Ln:

Ln<F<1.25 Ln, 1.137 Ln<G<1.42 Ln

Moreover, if the aperture 2 Ln of the array antenna (205) becomes larger due to an increase in the number of the antenna elements (241),(242), - - - (24*n*), the distance F between the input port (221) and S2 is increased in proportion to 2 Ln, resulting in an increase in the basic value of G.

Differently, in the present invention, for example, assuming that β=α/2, as a prerequisite to satisfying the Formula 5, η=Ln/2 F has to be equal to or less than 1 (η=Ln/2F≤1), and it is desirable to set F in a range of about 0.5 to 0.625 times Ln, and set g to about 1.137, in view of an advantage of being able to reduce an error in excitation phase at each of the output ports (231), (232), - - - (23*n*). Thus, desirable design can be achieved when F and G are set in the following respective ranges with respect to Ln:

0.5 Ln<F<0.625 Ln, 0.568 Ln<G<0.71 Ln

In this case, the Rotman lens can be designed to have a size which is ½ times a basic value of G when designed under the defined condition of β=α.

Figure 9:
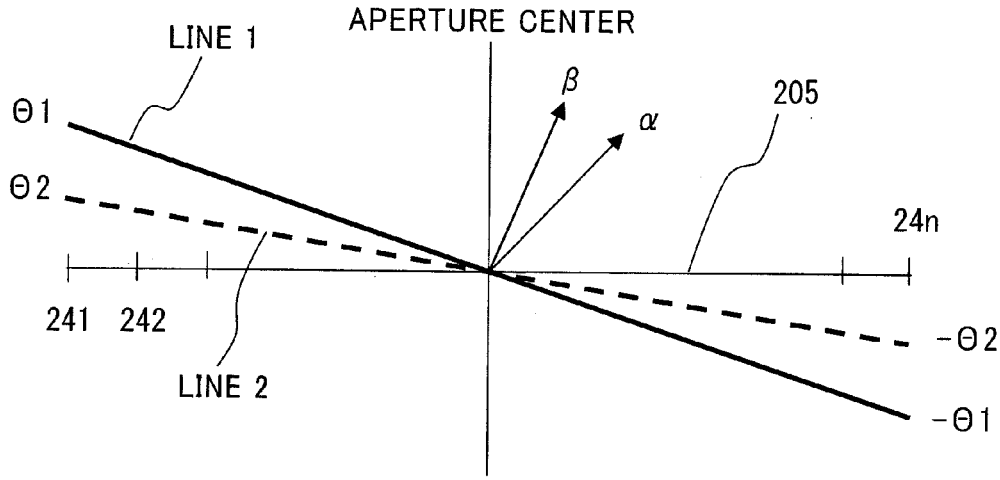
FIG. 9 is an explanatory diagram illustrating a phase inclination in an array antenna aperture plane depending on a given input port in the multi-beam antenna device according to the present invention.

In addition, in the multi-beam antenna of the present invention which is designed based on respective coordinates (x, y) of the output ports (231), (232), - - - , (23*n*) and respective electrical lengths w of the feeder lines (261),(262), - - - (26*n*), each calculated using the Formulas 1 to 3, when electric power is fed from a given one of the input ports which has an elevation angle α when viewed from S2, a phase inclination of a line representing respective excitation phases at the antenna elements (241), (242), - - - (24*n*) on the basis of that at an aperture center of the array antenna (205), as indicated by the straight line 2 in FIG. 9, is reduced by one-half as compared with the straight line 1 in FIG. 9 which represents respective excitation phases at the antenna elements (241), (242), - - - (24*n*) of the basic multi-beam antenna designed under the defined condition of β=α, and a spatial beam-forming direction β of the array antenna (205) is reduced to one-half of a spatial beam-forming direction α of the array antenna (205) in the basic multi-beam antenna designed under the defined condition of β=α.

Thus, in the present invention, under the condition of β<α, a shape of the Rotman lens is set to satisfy the relation of the Formula 6, so that it becomes possible to design a small-sized Rotman lens having a size which is β/α times a basic value of G when designed under the defined condition of β=α. This makes it possible to suppress an increase in loss of the Rotman lens which would otherwise occur in proportion to a size thereof. In addition, even if the aperture 2 Ln of the array antenna (205) becomes larger due to an increase in the number of the antenna elements (421), (242), - - - (24*n*), and thereby the distance F between the input port (221) and S2 is increased in proportion to 2 Ln, a small-sized Rotman lens having a size reduced to β/α times the basic value of G when designed under the defined condition of β=α can be designed so as to make up a multi-beam antenna device having a spatial beam-forming direction β of the array antenna (205).

Figure 8:
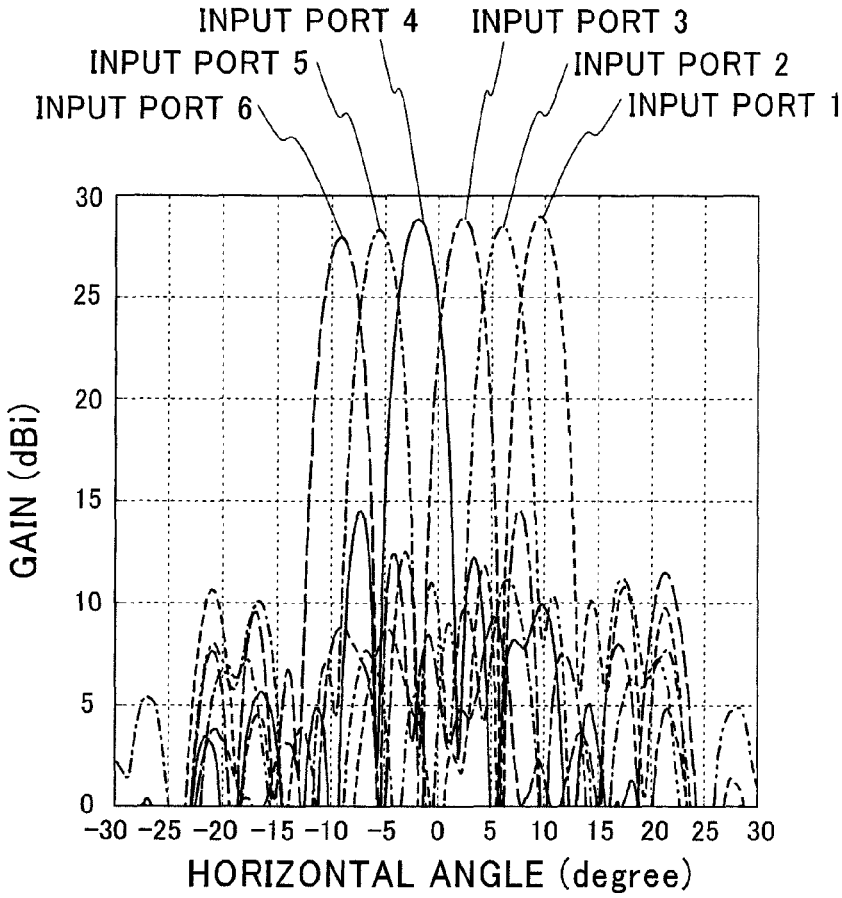
FIG. 8 is an explanatory diagram illustrating a first directivity characteristic of the multi-beam antenna device according to the present invention.
Figure 10:
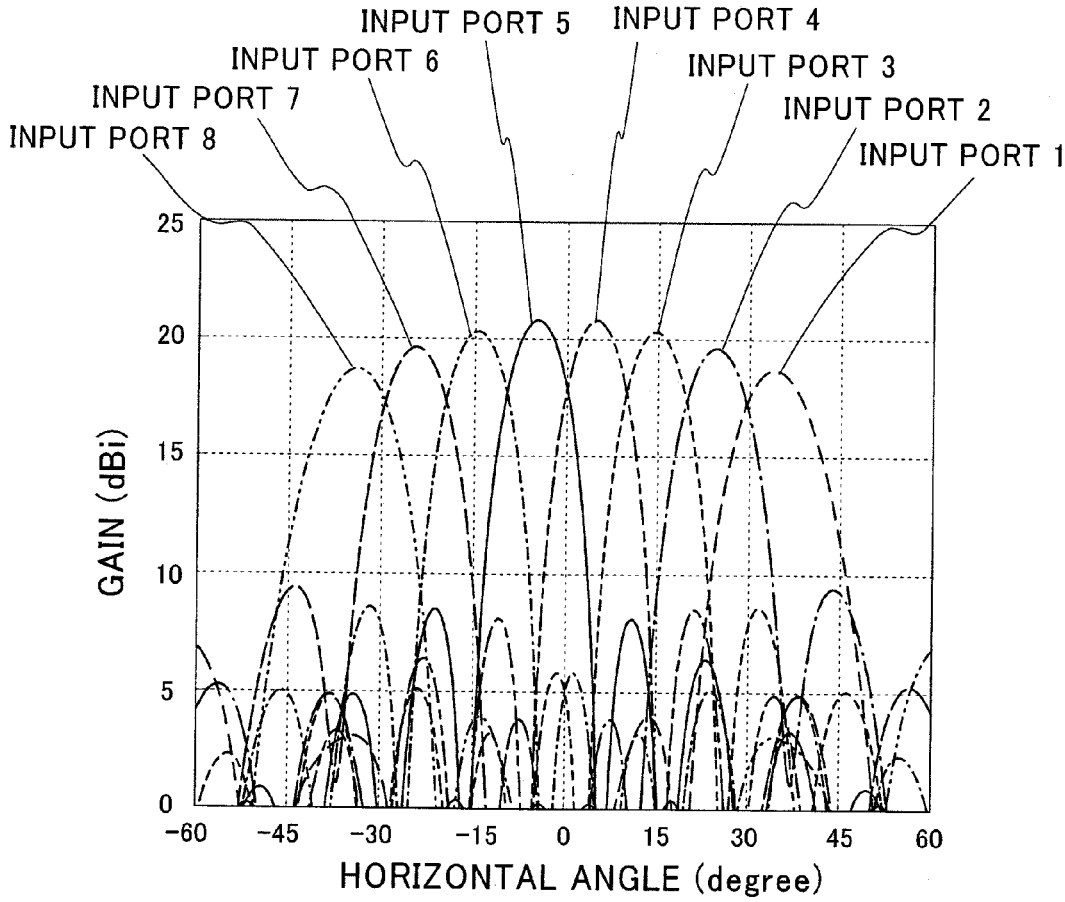
FIG. 10 is an explanatory diagram illustrating a second directivity characteristic of the multi-beam antenna device according to the present invention.
Figure 11:
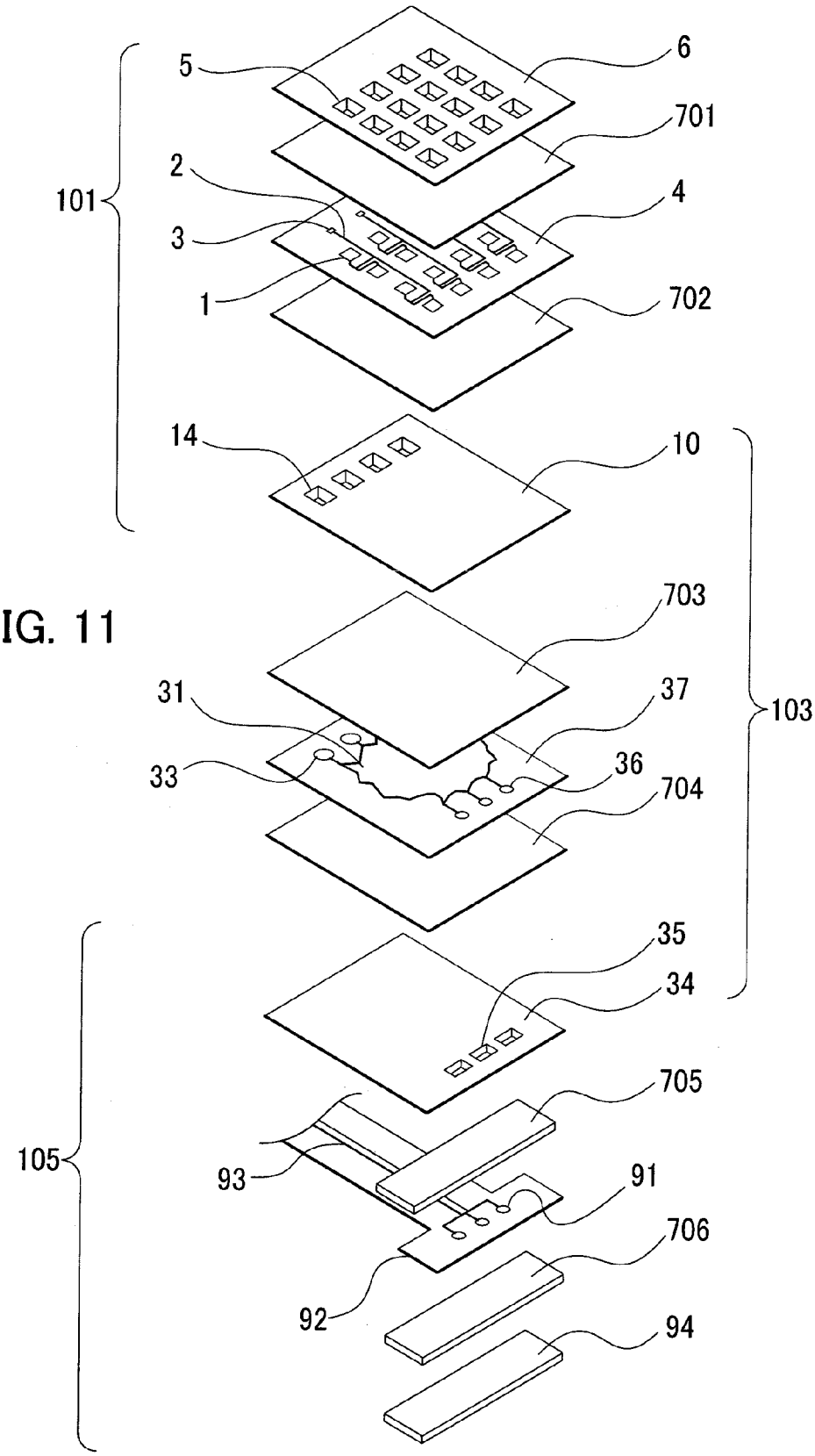
FIG. 11 is an explanatory diagram illustrating a configuration of an example of a conventional multi-beam antenna device.
Figure 12:
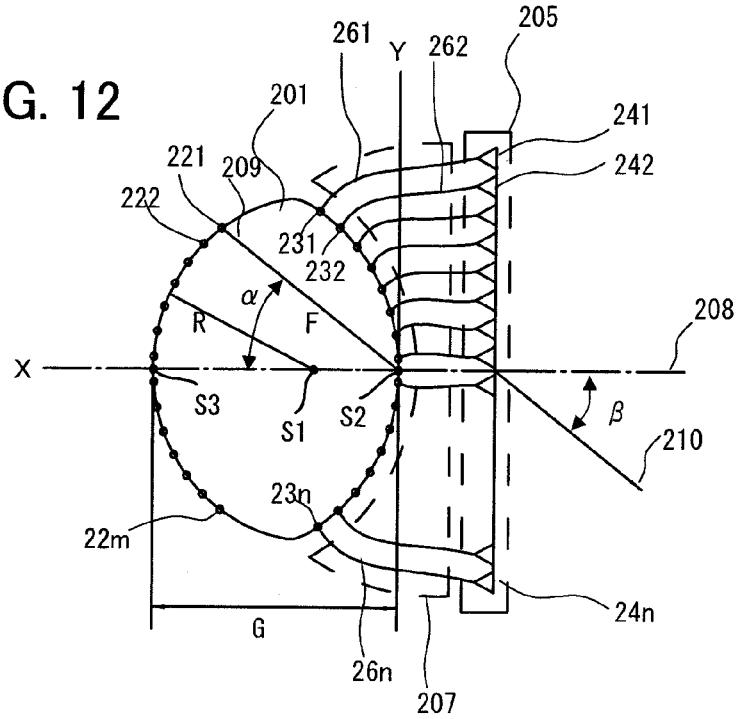
FIG. 12 is an explanatory diagram illustrating a Rotman lens pattern according to a conventional technique.
Figure 13:
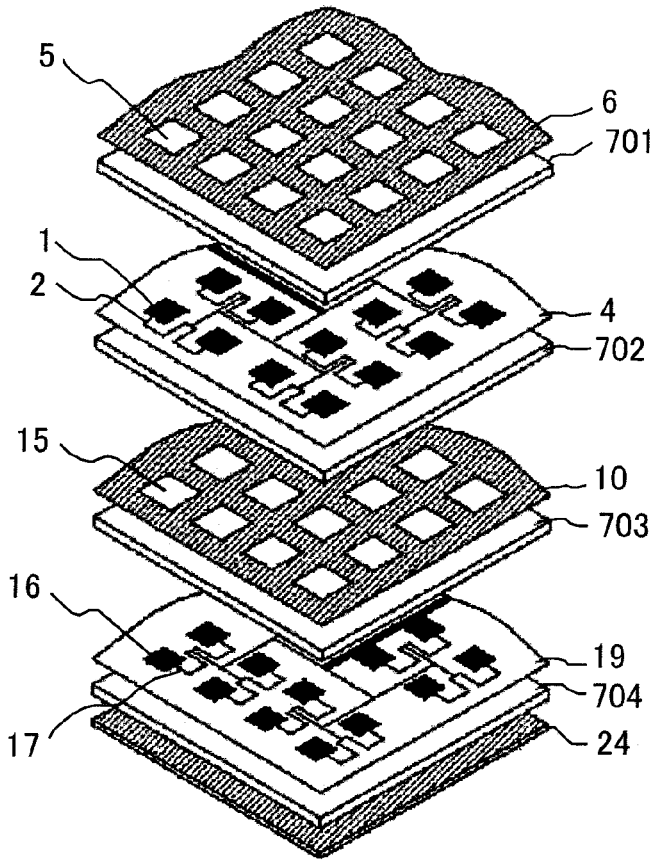
FIG. 13 is a perspective view showing a configuration of a two-layer triplate antenna according to a conventional technique.

As shown in FIGS. 1 to 6, in a multi-beam antenna device according to a first embodiment of the present invention, the Rotman lens is formed in a triplate structure. In this case, a taper shape in complicated input and output port portions, and phase-adjusting third and fourth feeder lines (32), (50) can be easily formed by means of etching or the like. Further, a first connection portion (3) of a first antenna substrate (4) and a fifth connection portion (51) of the fourth feeder line (50) can be electromagnetically coupled together via a sixth slit (30) provided in a seventh ground conductor (24), so that it becomes possible to achieve a second directivity characteristic as illustrated in FIG. 10. Similarly, a second connection portion (18) of a second antenna substrate (19) and a third connection portion (33) of the third feeder line (32) can be electromagnetically coupled together via a fifth slit (29) formed in the seventh ground conductor (24), so that it becomes possible to achieve a first directivity characteristic as illustrated in FIG. 8. The first and second directivity characteristics can be effected independently. In addition, the multi-beam antenna device according to the first embodiment can be configured as a low-loss multi-beam antenna device with a simple laminated structure of all components thereof.

The above description has been made on an assumption that the present invention is applied to a commonly-used hollow parallel-plate Rotman lens, or a triplate structure in which a first or second Rotman lens substrate (37 or 55) is supported by a dielectric having a low ϵ approximately equal to that of air. In a parallel plate or a triplate structure using a dielectric having a relative permittivity ϵr, it is apparent that the Formula 6 in the present invention may be handled as the following Formula 7.

$$\eta=(1/\sqrt{\epsilon r})\cdot(\beta/\alpha)\cdot(Ln/F)<1 \quad (7)$$

Figure 3:
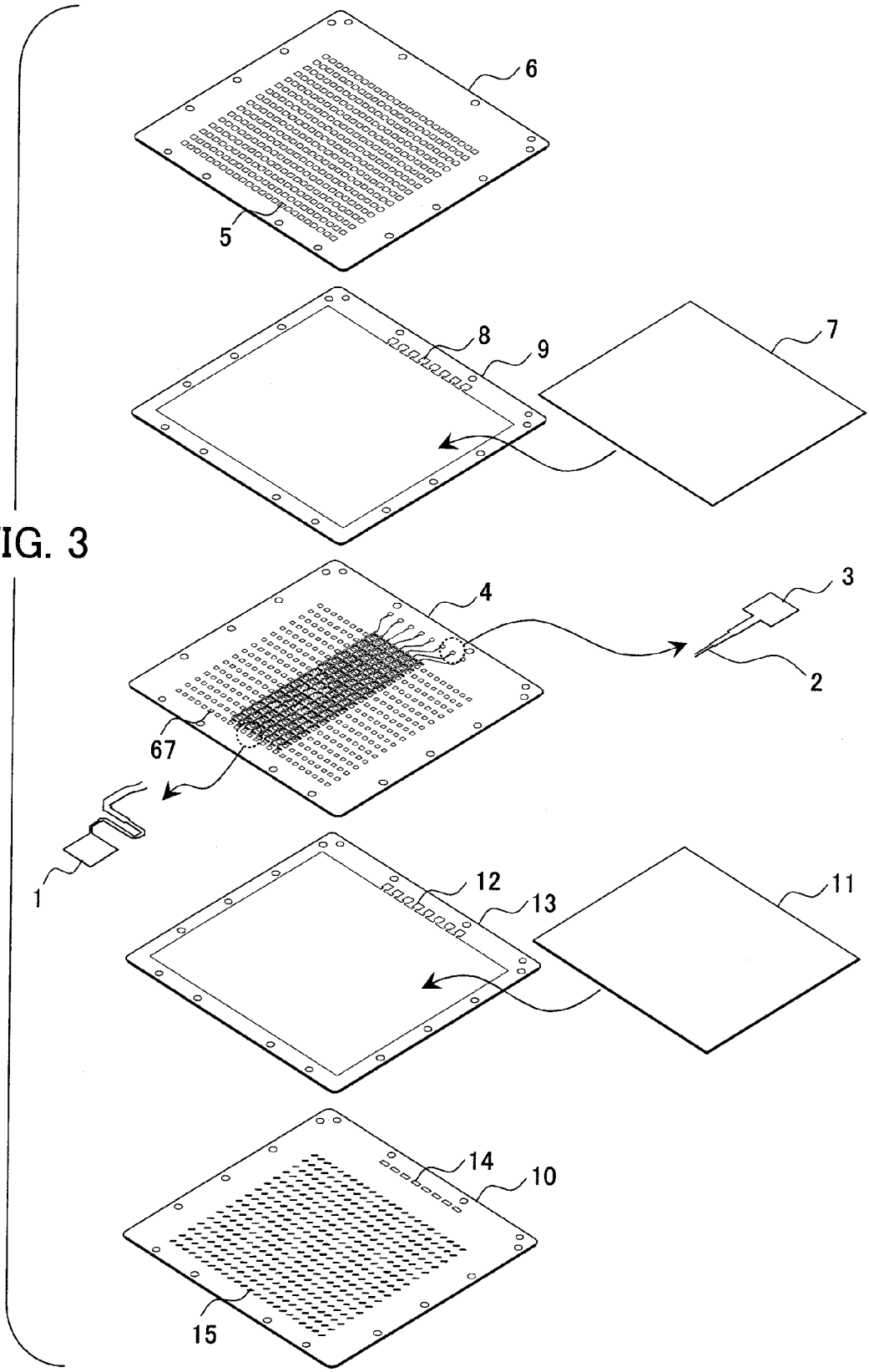
FIG. 3 is an explanatory diagram illustrating a first antenna section in the first configuration of the multi-beam antenna device according to the present invention.
Figure 4:
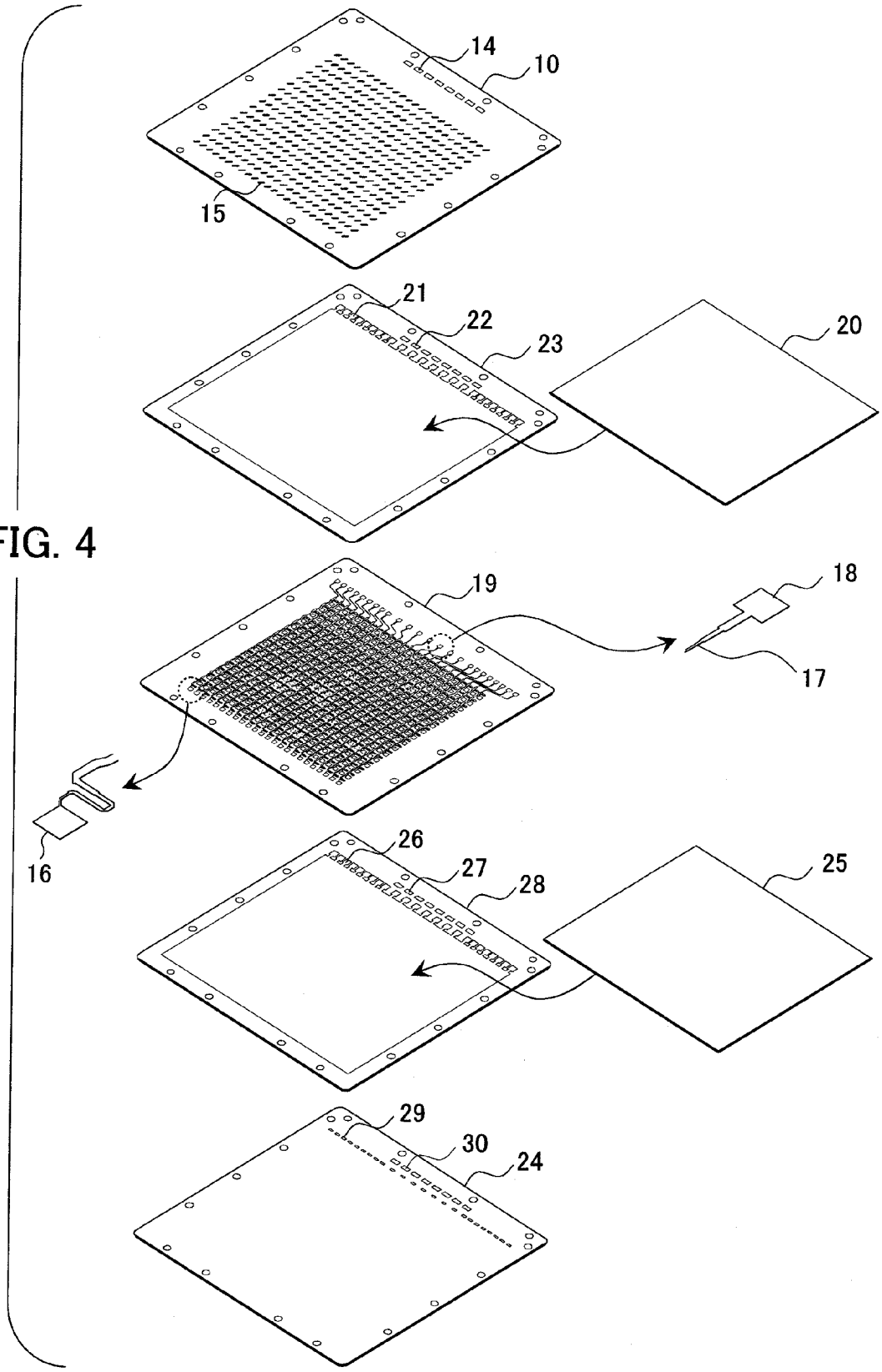
FIG. 4 is an explanatory diagram illustrating a second antenna section in the first configuration of the multi-beam antenna device according to the present invention.

In the multi-beam antenna device according to the first embodiment, a first radiation element (1) formed in the first antenna substrate (4) and a second radiation element (16) formed in the second antenna substrate (19) illustrated in FIGS. 3 and 4 are fed with electric power from respective directions perpendicular to each other, i.e., crossing at 90 degrees, and electromagnetically coupled together through a corresponding one of a plurality of second slots (15) formed in a fourth ground conductor (10) so as to function to radiate orthogonally polarized waves having a desired frequency, independently. A plurality of the antenna elements are arranged to form the array antenna (205) as a whole.

In the above multi-beam antenna device, as shown in FIGS. 3 to 6, a second ground conductor (9) and a third ground conductor (13) disposed on respective ones of upper and lower sides of the first antenna substrate (4), a fifth ground conductor (23) and a sixth ground conductor (28) disposed on respective ones of upper and lower sides of the second antenna substrate (19), and an eighth ground conductor (42) and a ninth ground conductor (47) disposed on respective ones of upper and lower sides of the first Rotman lens substrate (37), and an eleventh ground conductor (60) and a twelfth ground conductor (65) disposed on respective ones of upper and lower sides of the second Rotman lens substrate (55), hold the first and second antenna substrates (4), (19) and the first and second Rotman lens substrate (37), (55) in a spaced manner, while forming metal walls around respective ones of the first connection portion (3) formed in the first antenna substrate (4), the second connection portion (18) formed in the second antenna substrate (19), the third connection portion (33) formed in the first Rotman lens substrate (37) and the fifth connection portion (51) formed in the second Rotman lens substrate (55), which contributes to efficient transmission of electric power without leakage to the surroundings, so as to achieve low-loss characteristics even at high frequencies.

In order to stably hold the first and second antenna substrates (4), (19) and the first and second Rotman lens substrates (37), (55), each of the spaces may be filled with a respective one of first to eighth dielectrics (7), (11), (20), (25), (38), (43), (56), (61).

As for each of a fourth connection portion (36) and a sixth connection portion (54) serving as an input port portion of the antenna device, a metal wall is formed therearound based on a respective one of a combination of a sixth coupling hole-defining portion (40) of the eighth ground conductor (42) and an eighth coupling hole-defining portion (45) of the ninth ground conductor (47), and a combination of a tenth coupling hole-defining portion (40) of the eleventh ground conductor (60) and a twelfth coupling hole-defining portion (63) of the twelfth ground conductor (65), which contributes to efficiently transmitting electric power a fifth waveguide opening portion (66) and a second waveguide opening portion (53) each formed in the thirteenth ground conductor (52), without leakage to the surroundings, so as to achieve low-loss characteristics even at high frequencies.

In addition, based on the simple laminated structure of the components, transmission/receiving of electric power is performed by means of electromagnetic coupling, so that it is not necessary to ensure high positional accuracy during assembly at a level of conventional assembly accuracy.

Preferably, in the multi-beam antenna device according to the first embodiment, as each of the first and second antenna substrates (4), (19) and the first and second Rotman lens substrates (37), (55), a flexible substrate prepared by laminating a copper foil to a polyimide film is employed, wherein each of the first and second radiation elements (1), (16), first and second feeder lines (2), (17), the first and second connection portions (3), (18), first and second Rotman lenses (31), (49), the third and fourth feeder lines (32). (50), and the third and fifth connection portions (33), (51) and the fourth and sixth connection portions (36), (54), is formed by etchingly removing an unnecessary part of the copper foil.

The flexible substrate may be prepared by employing a film as a base material and laminating a metal foil, such as a copper foil, onto the film. In this case, a plurality of the radiation elements and a plurality of the feeder lines connecting therebetween may be formed by etchingly removing an unnecessary part of the copper foil (metal foil). Alternatively, the flexible substrate may be made up using a copper-cladded laminate prepared by laminating a copper foil on a thin resin sheet consisting of a glass cloth impregnated with resin. The film may be made of a material, such as polyethylene, polypropylene, polytetrafluoroethylene, ethylene fluoride-polypropylene copolymer, ethylene-tetrafluoroethylene copolymer, polyamide, polyimide, polyamide-imide, polyarylate, thermoplastic polyimide, polyetherimide, polyether ether ketone, polyethylene terephthalate, polybutylene terephthalate, polystyrene, polysulfone, polyphenylene ether, polyphenylene sulfide, or polymethylpentene. An adhesive may be used for lamination between the film and the metal foil. In view of thermal resistance, dielectric characteristics and versatility, it is preferable to use a flexible substrate prepared by laminating a copper foil to a polyimide film. In view of dielectric characteristics, a fluorine-based film is preferably used.

As the ground conductor or the metal spacer for use in the multi-beam antenna device according to the first embodiment, a metal plate or a coated plastic plate may be used. Particularly, it is preferable to use an aluminum plate in view of an advantage of being able to produce the ground conductor or the metal spacer in a low weight and at a low cost. Alternatively, the ground conductor or the metal spacer may be made up using a flexible substrate prepared by employing a film as a base material and laminating a copper foil onto the film, or a copper-cladded laminate prepared by laminating a copper foil on a thin resin sheet consisting of a glass cloth impregnated with resin. A slot or coupling hole-defining portion formed in the ground conductor may be formed by punching based on mechanical press or by etching. In view of simplicity, productivity, etc., the punching based on mechanical press is preferable.

For example, as the each of the first to eighth dielectrics (7), (11), (20), (25), (38), (43), (56), (61) for use in the multi-beam antenna device according to the first embodiment, it is preferable to use a foamed material having a small relative permittivity with respect to air. The foamed material may include: a polyolefin-based foamed material such as polyethylene or polypropylene; a polystyrene-based foamed material; a polyurethane-based foamed material; a polysilicone-based foamed material; and a rubber-based foamed material. Among them, a polyolefin-based foamed material is preferable, because it is lower in the relative permittivity with respect to air.

(Second Embodiment)

The multi-beam antenna device according to the first embodiment will be further viewed in terms of dimensions of each member, etc., and described as a second embodiment with reference to FIGS. 3 to 6. Each of the first to thirteenth ground conductors (6), (9), (13), (10), (23), (28), (24), (42), (47), (34), (60), (65), (52) is made up using an aluminum plate having a thickness of 0.3 mm. Further, each of the first to eighth dielectrics (7), (11), (20), (25), (38), (43), (56), (61) is made up using a polyethylene foam having a thickness of 0.3 mm and a relative permittivity of about 1.1. Each of the first and second antenna substrates (4), (19) and the first and second Rotman lens substrates (37), (55) is made up using a flexible substrate prepared by laminating a copper foil (having a thickness, for example, of 25 μm) to a polyimide film (having a thickness, for example, of 25 μm), wherein each of the first and second radiation elements (1), (16), the first and second feeder lines (2), (17), the first and second connection portions (3), (18), the first and second Rotman lenses (31), (49), the third and fourth feeder lines (32), (50), the third and fifth connection portions (33), (51) and the fourth and sixth connection portions (36), (54), is formed by etchingly removing an unnecessary part of the copper foil. Each of the ground conductors is made up using an aluminum plate subjected to punching based on mechanical press.

In this embodiment, each of the first and second radiation elements (1), (16) is formed in a square shape having a side length of 1.5 mm which is about 0.38 times a free space wavelength (λo=3.95 mm) at a frequency of 76 GHz. Further, each of a plurality of first slots (5) formed in the first ground conductor (6) and a plurality of second slits (15) formed in the fourth ground conductor (10) is formed in a square shape having a side length of 2.3 mm which is about 0.58 times the free space wavelength (λo=3.95 mm) at a desired frequency of 76 GHz (or an oblong shape having a long-side length of 2.3 mm), and each of a first slit (14) formed in the fourth ground conductor (10), a third slit (22) formed in the fifth ground conductor (23), a fourth slit (27) formed in the sixth ground conductor (28), the sixth slit (30) formed in the seventh ground conductor (24), a seventh slit (41) formed in the eighth ground conductor (42), an eighth slit (46) formed in the ninth ground conductor (47), and a ninth slit (48) and a first waveguide opening portion (35) formed in the tenth ground conductor (34), is formed as a waveguide opening having a size of 1.25 mm length×2.53 mm width. As illustrated in FIG. 3, eight antenna element lines each made up of a part of the first radiation elements (1) formed in the first antenna substrate (4), the fourth ground conductor (10), a part of the first slots (5) formed in the first ground conductor (6), and the first feeder line (2), are arranged at a pitch of 3.0 mm which is about 0.77 times the free space wavelength (λo=3.95 mm) at a desired frequency of 76 GHz, to form an array antenna (205) having an antenna aperture 2 Ln of 8×0.77 λo as a whole. The number of the first radiation elements (1) in each of the antenna element lines is set to 16, wherein the first radiation elements (1) are arranged at a pitch of 3.5 mm which is about 0.89 times the free space wavelength (λo=3.95 mm) at a desired frequency of 76 GHz, and each of the sixteen first radiation elements (1) is fed with electric power and excited in the same phase. As illustrated in FIG. 4, twenty-four antenna element lines each made up of a part of the second radiation element (16) formed in the second antenna substrate (19), the seventh ground conductor (24), a part of the second slits (15) formed in the fourth ground conductor (10), and the second feeder line (17), are arranged at a pitch of 3.0 mm which is about 0.77 times the free space wavelength (λo=3.95 mm) at a desired frequency of 76 GHz, to form an array antenna (205) having an antenna aperture 2 Ln of 24×0.77 λo as a whole. The number of the second radiation elements (16) in each of the antenna element lines is set to 16, wherein the second radiation elements (16) are arranged at a pitch of 3.5 mm which is about 0.89 times the free space wavelength (λo=3.95 mm) at a desired frequency of 76 GHz, and each of the sixteen second radiation elements (16) is fed with electric power and excited in the same phase. Further, the first antenna substrate (4) located just above the second radiation elements (16) has a plurality of non-fed or parasitic elements (67) disposed in a region devoid of the first radiation elements (1).

Figure 6:
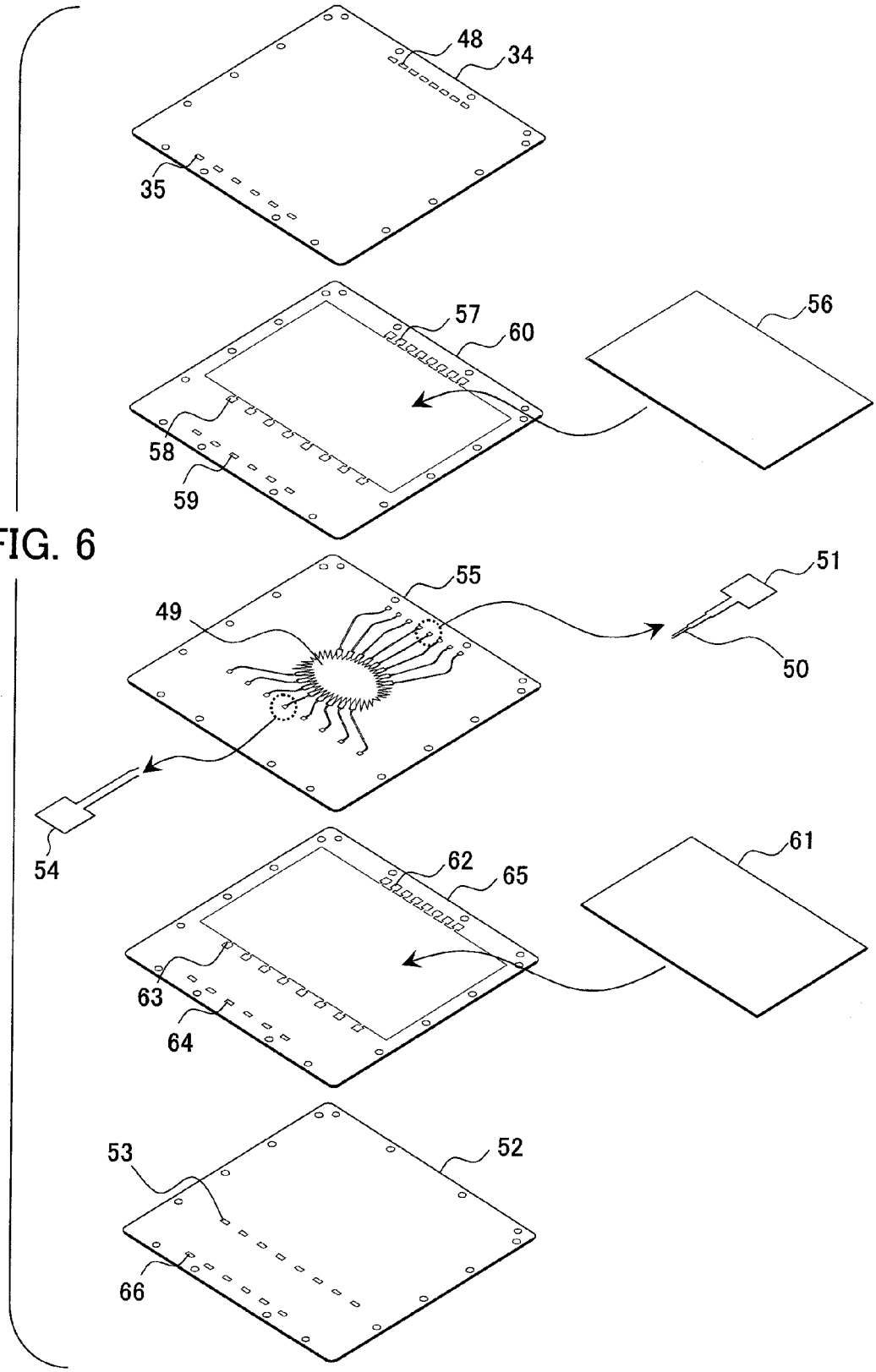
FIG. 6 is an explanatory diagram illustrating a second Rotman lens section in the first configuration of the multi-beam antenna device according to the present invention.
Figure 7:
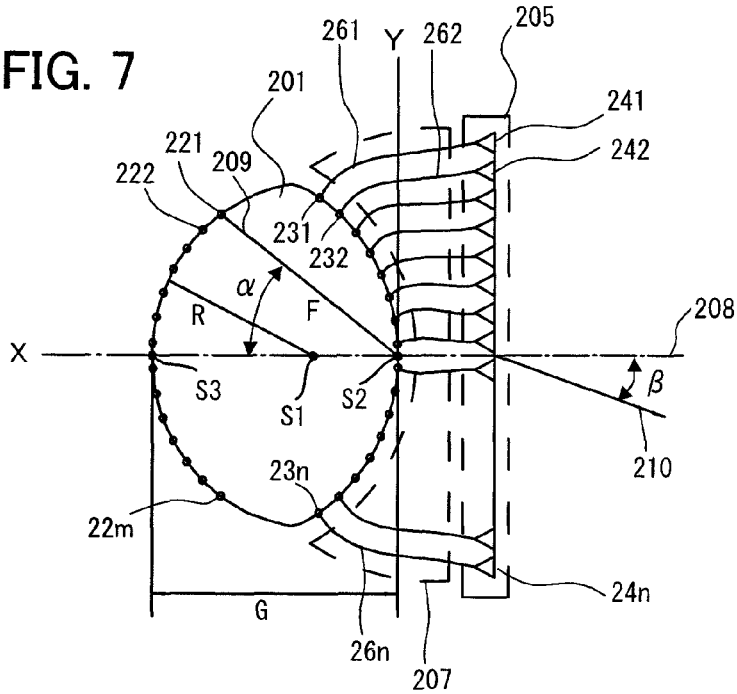
FIG. 7 is an explanatory diagram illustrating a Rotman lens pattern in the multi-beam antenna device according to the present invention.

In this embodiment, the second Rotman lens (49) having the eight output ports to be formed in the second Rotman lens substrate (55) illustrated in FIG. 6 is designed based on respective coordinates (x, y) of the output ports and respective electrical lengths w of the feeder lines calculated using the Formulas 1 to 3 on an assumption that F=3.5 λo, and G=4.1 λo, in the following range: 0.568 Ln<G<0.71 Ln, while satisfying the Formula 6 wherein β=α/2, i.e., a condition of η=(½)·(Ln/F)<1. Specifically, the size G of the second Rotman lens (49) is set to a value which is about 4.1 times the free space wavelength (λo=3.95 mm) at a desired frequency of 76 GHz, i.e., to 16 mm.

Figure 2:
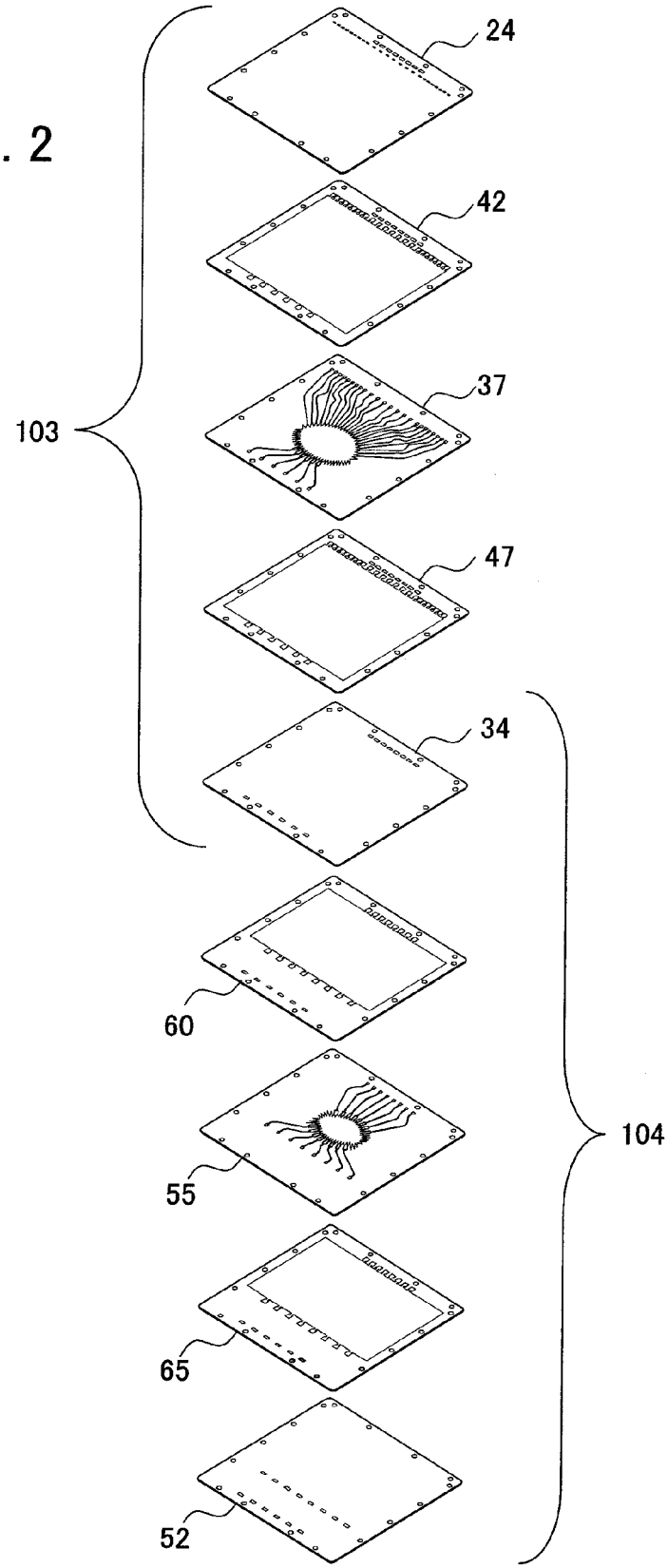
FIG. 2 is an additional explanatory diagram illustrating the first configuration of the multi-beam antenna device according to the present invention.

The above members were actually laminated in order as illustrated in FIG. 2 to make up a multi-beam antenna device, and a measurement unit was connected to the multi-beam antenna device to measure characteristics thereof. As a result, a reflectance loss at the a second waveguide opening portion (53) corresponding to each of eight input ports was equal to or less than −15 dB, and a gain directionality corresponding to each of the eight input ports was obtained as illustrated in FIG. 10. Further, it could be ascertained that a beam of the array antenna (205) can be formed in a direction at an angle β which is about one-half of an input port angle α, as illustrated in Table 1. In this case, an insertion loss of the second Rotman lens (49) having the size G=16 mm was about 2.5 dB.

TABLE 1

| Input Port No. | Input Port Angle α (degree) | Antenna Beam Angle β (degree) |
|---|---|---|
| 1 | 70 | 34.3 |
| 2 | 50 | 24.5 |
| 3 | 30 | 14.6 |
| 4 | 10 | 4.8 |
| 5 | −10 | −4.8 |
| 6 | −30 | −14.6 |
| 7 | −50 | −24.5 |
| 8 | −70 | −34.3 |

Figure 5:
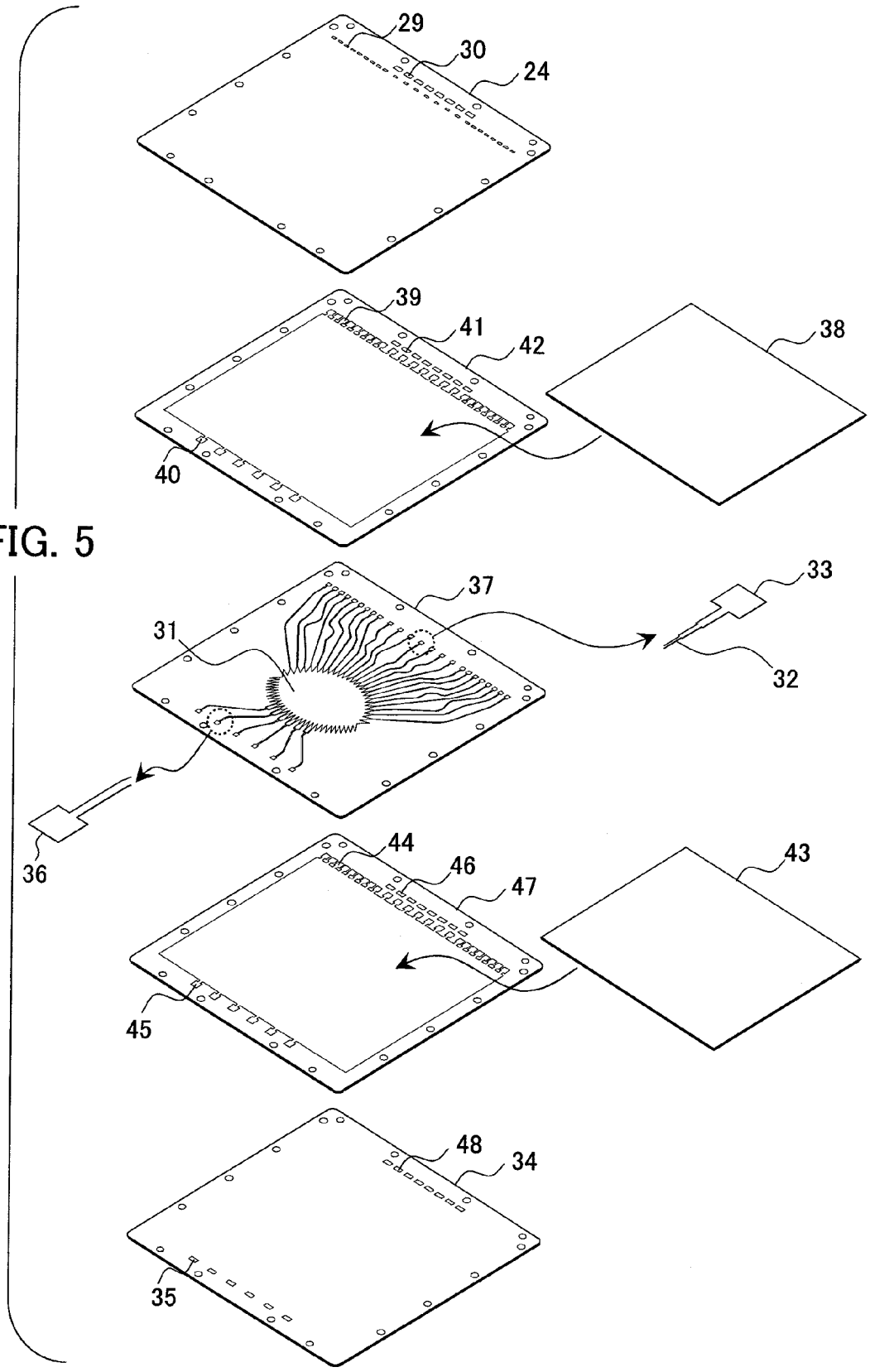
FIG. 5 is an explanatory diagram illustrating a first Rotman lens section in the first configuration of the multi-beam antenna device according to the present invention.

Further, the first Rotman lens (37) having the twenty four output ports to be formed in the first Rotman lens substrate (37) illustrated in FIG. 5 is designed based on respective coordinates (x, y) of the output ports and respective electrical lengths w of the feeder lines calculated using the Formulas 1 to 3 on an assumption that F=5 λo, and G=5.7 λo, in the following range: 0.568 Ln<G<0.71 Ln, while satisfying the Formula 6 wherein β=α/2, i.e., a condition of η=(½)·(Ln/F)<1. Specifically, the size G of the first Rotman lens (31) is set to a value which is about 5.7 times the free space wavelength (λo=3.95 mm) at a desired frequency of 76 GHz, i.e., to 22.5 mm.

The above members were actually laminated in order as illustrated in FIG. 2 to make up a multi-beam antenna device, and a measurement unit was connected to the multi-beam antenna device to measure characteristics thereof. As a result, a reflectance loss at a fifth waveguide opening portion (66) corresponding to each of the six input ports was equal to or less than −15 dB, and a gain directionality corresponding to each of six input ports was obtained as illustrated in FIG. 8. Further, it could be ascertained that a beam of the array antenna (205) can be formed in a direction at an angle β which is about one-half of an input port angle α, as illustrated in Table 2. In this case, an insertion loss of the first Rotman lens (31) having the size G=22.5 mm was about 2.5 dB.

TABLE 2

| Input Port No. | Input Port Angle α (degree) | Antenna Beam Angle β (degree) |
|---|---|---|
| 1 | 19 | 9.4 |
| 2 | 12 | 5.9 |
| 3 | 5 | 2.3 |
| 4 | −5 | −2.0 |
| 5 | −12 | −5.5 |
| 6 | −19 | −9.2 |

On the other hand, in a conventional Rotman lens designed in the following range: 1.137 Ln<G<1.42 Ln, while satisfying the condition of the Formula 5 under the defined condition of $\beta=\alpha$, i.e., $\eta=Ln/F<1$, it is at least necessary that G=1.137, Ln=10.5 λo, so that the size G of the conventional Rotman lens is set to a value which is about 10.5 times the free space wavelength (λo=3.95 mm) at a desired frequency of 76 GHz, i.e., to 41.5 mm. In this case, an insertion loss of the Rotman lens (1) was about 5 dB.

As above, the multi-beam antenna device according to the second embodiment is improved in relative gain by 2.5 dB or more, in comparison on the basis of a loss in a multi-beam antenna device formed by the conventional design process, so that it can achieve excellent characteristics.

(Third Embodiment)

Figure 16:
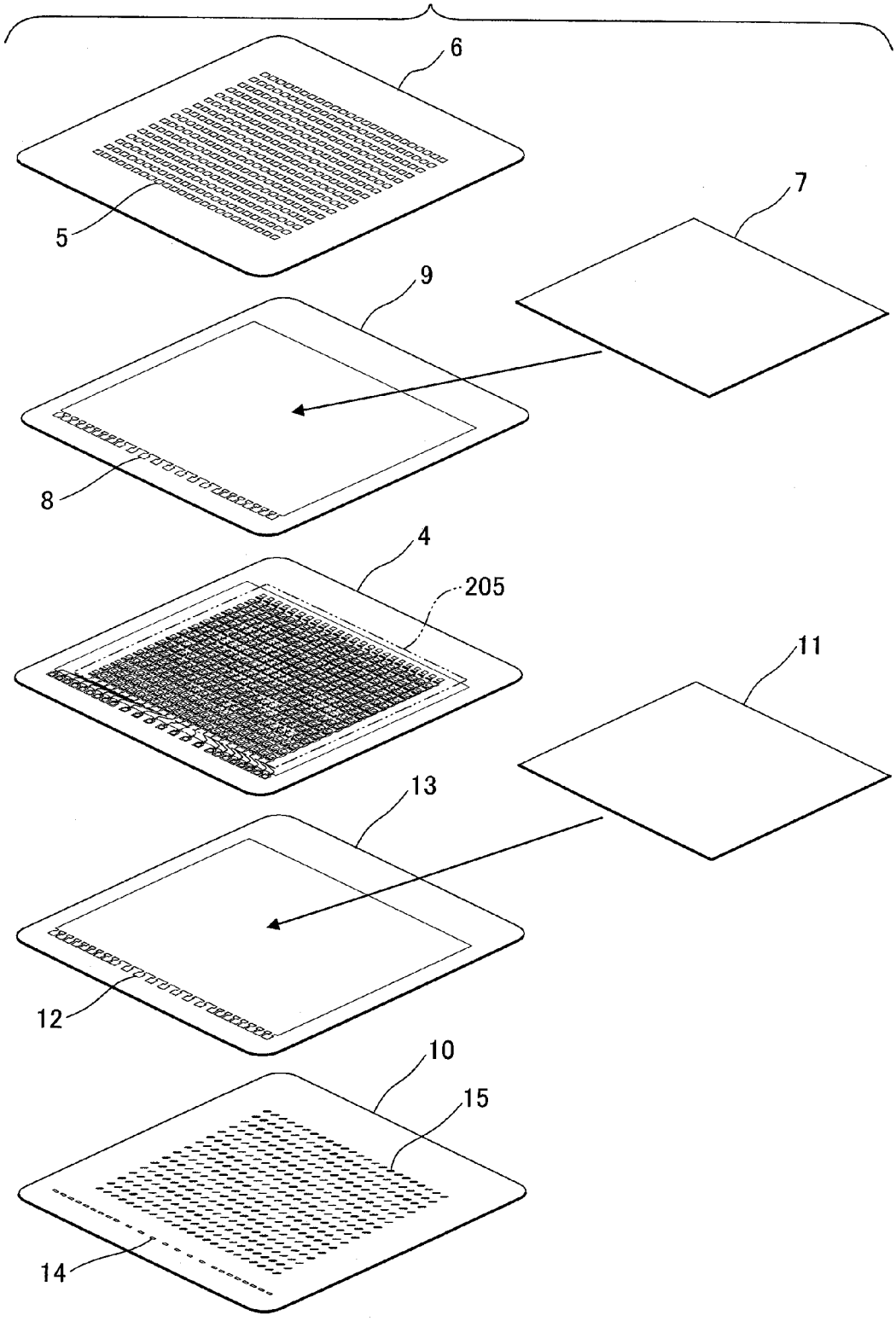
FIG. 16 is an explanatory diagram illustrating a first antenna section in the second configuration of the multi-beam antenna device according to the present invention (third embodiment).
Figure 17:
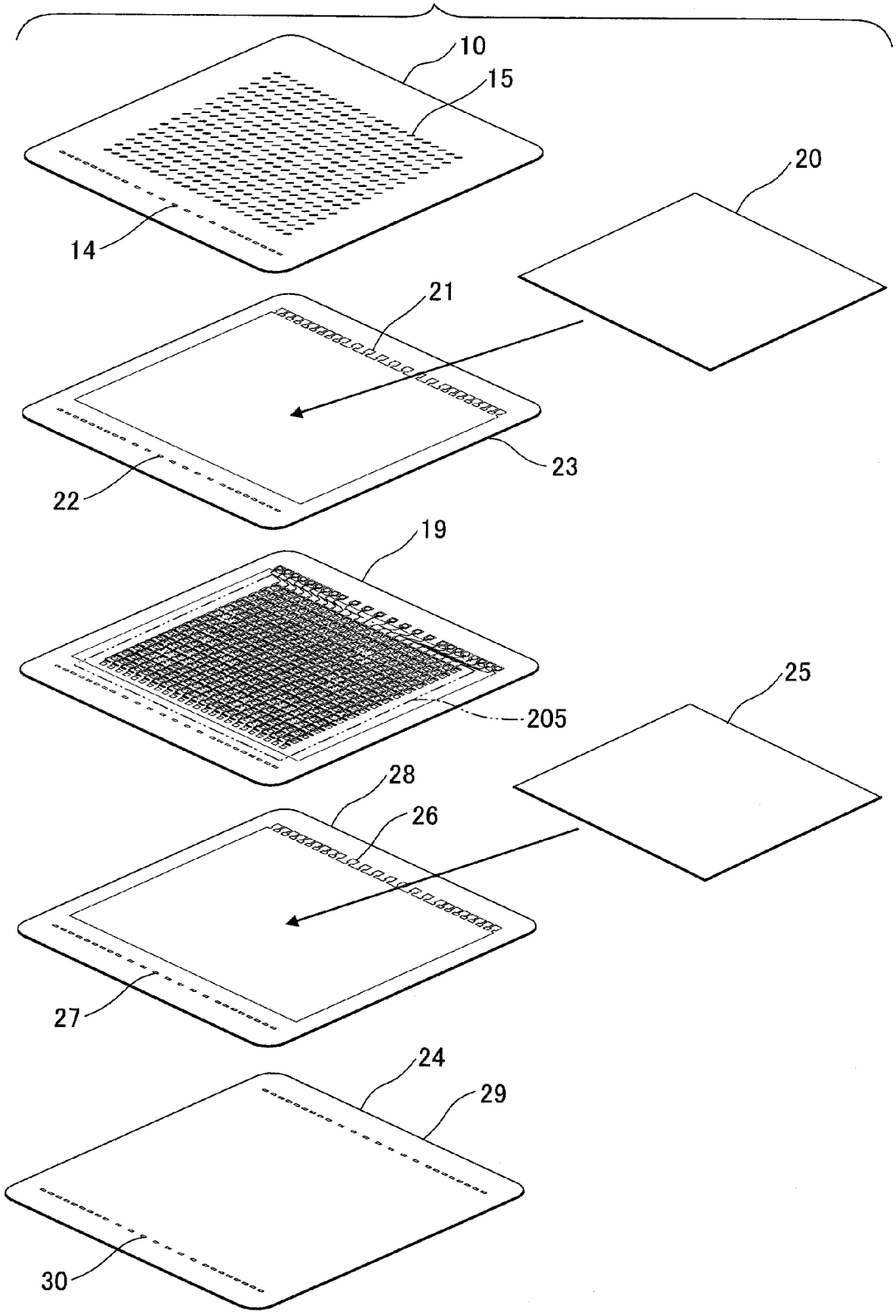
FIG. 17 is an explanatory diagram illustrating a second antenna section in the second configuration of the multi-beam antenna device according to the present invention (third embodiment).

With reference to FIGS. 16 to 19, a multi-beam antenna device according to a third embodiment of the present invention will be described below. Each of a first radiation element (1) (not illustrated) of a first antenna substrate (4) and a second radiation element (16) (not illustrated) of a second antenna substrate (19) is formed in a square shape having a side length of 1.5 mm which is about 0.38 times the free space wavelength (λo=3.95 mm) at a frequency of 76 GHz. Each of a plurality of first slot (5) formed in a first ground conductor (10), and a plurality of second slits (15) formed in a fourth ground conductor (10), is formed in a square shape having a side length of 2.3 mm which is about 0.58 times the free space wavelength (λo=3.95 mm) at a frequency of 76 GHz. Each of a first slit (14) formed in the fourth ground conductor (10), a third slit (22) formed in a fifth ground conductor (23), a fourth slit (27) formed in a sixth ground conductor (28), a sixth slit (30) formed in a seventh ground conductor (24), a seventh slit (41) formed in an eighth ground conductor (42), an eighth slit (46) formed in a ninth ground conductor (47), and a ninth slit (48) and a first waveguide opening portion (35) formed in a tenth ground conductor (34), is formed as a waveguide opening having a size of 1.25 mm length×2.53 mm width. As illustrated in FIG. 16, twenty-four antenna element lines each made up of a part of the first radiation elements (1) formed in the first antenna substrate (4), the fourth ground conductor (24), a part of the first slots (5) formed in the first ground conductor (6), and a first feeder line (2) (not illustrated), are arranged at a pitch of 3.0 mm which is about 0.77 times the free space wavelength (λo=3.95 mm) at a desired frequency of 76 GHz, to form an array antenna (205) having an antenna aperture 2 Ln of 24×0.77 λo as a whole. The number of the first radiation elements (1) in each of the antenna element lines is set to 16, wherein the first radiation elements (1) are arranged at a pitch of 3.5 mm which is about 0.89 times the free space wavelength (λo=3.95 mm) at a desired frequency of 76 GHz, and each of the sixteen first radiation elements (1) is fed with electric power and excited in the same phase. As illustrated in FIG. 17, twenty-four antenna element lines each made up of a part of the second radiation element (16) formed in the second antenna substrate (19), the fourth ground conductor (24), a part of the second slits (15) formed in the first ground conductor (10), and a second feeder line (17) (not illustrated), are arranged at a pitch of 3.0 mm which is about 0.77 times the free space wavelength (λo=3.95 mm) at a desired frequency of 76 GHz, to form an array antenna (205) having an antenna aperture 2 Ln of 24×0.77 λo as a whole. The number of the second radiation elements (16) in each of the antenna element arrays is set to 16, wherein the second radiation elements (16) are arranged at a pitch of 3.5 mm which is about 0.89 times the free space wavelength (λo=3.95 mm) at a desired frequency of 76 GHz, and each of the sixteen second radiation elements (16) is fed with electric power and excited in the same phase.

Figure 18:
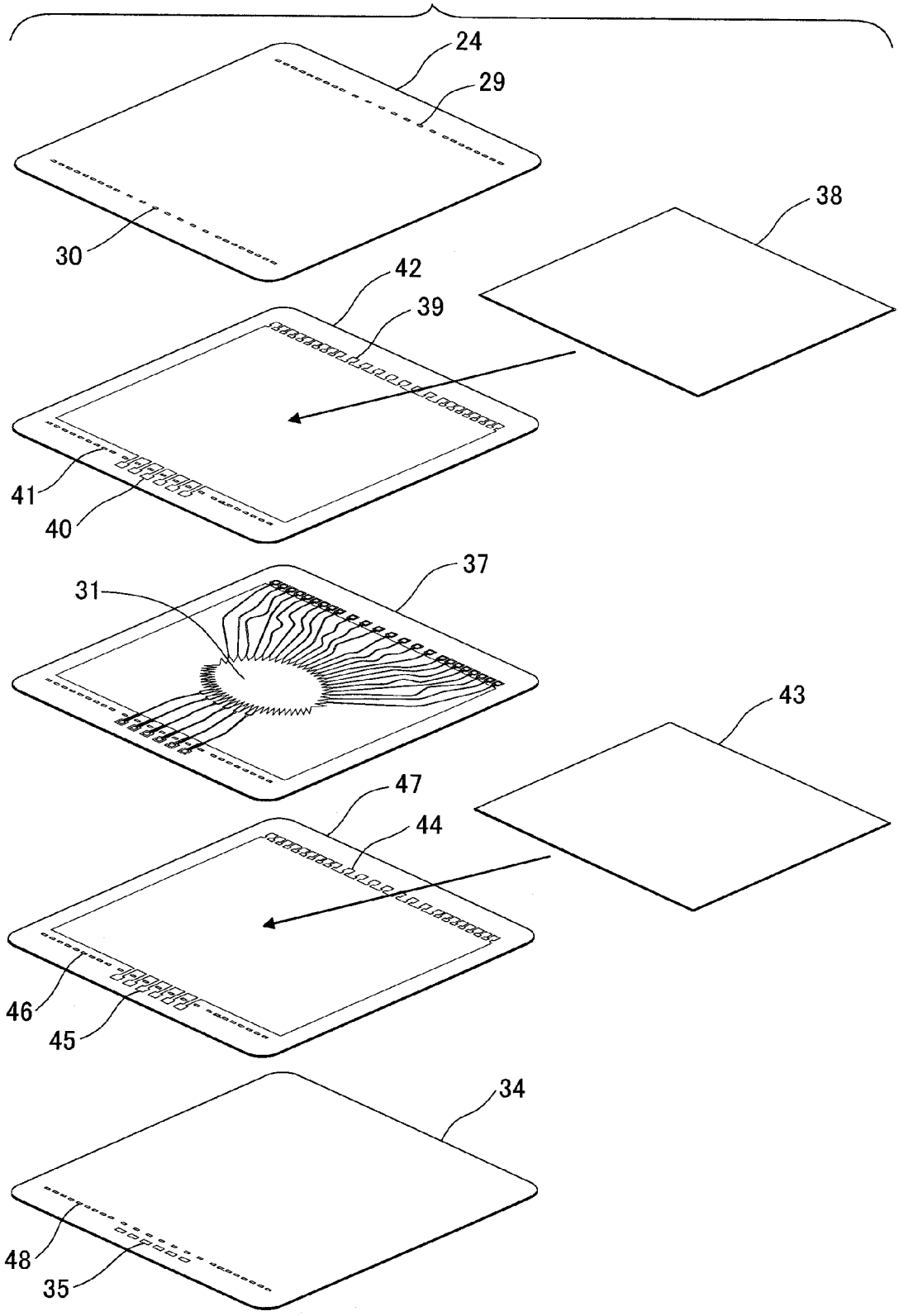
FIG. 18 is an explanatory diagram illustrating a first Rotman lens section in the second configuration of the multi-beam antenna device according to the present invention (third embodiment).

In this embodiment, the first Rotman lens (37) having the twenty four output ports to be formed in the first Rotman lens substrate (37) illustrated in FIG. 18 is designed based on respective coordinates (x, y) of the output ports and respective electrical lengths w of the feeder lines calculated using the Formulas 1 to 3 on an assumption that F=5 λo, and G=5.7 λo, in the following range: 0.568 Ln<G<0.71 Ln, while satisfying the Formula 6 wherein $\beta=\alpha/2$, i.e., a condition of $\eta=(1/2)\cdot(Ln/F)<1$. Specifically, the size G of the first Rotman lens (31) is set to a value which is about 5.7 times the free space wavelength (λo=3.95 mm) at a desired frequency of 76 GHz, i.e., to 22.5 mm (the size G of the second Rotman lens (49) is set in the same manner).

Figure 14:
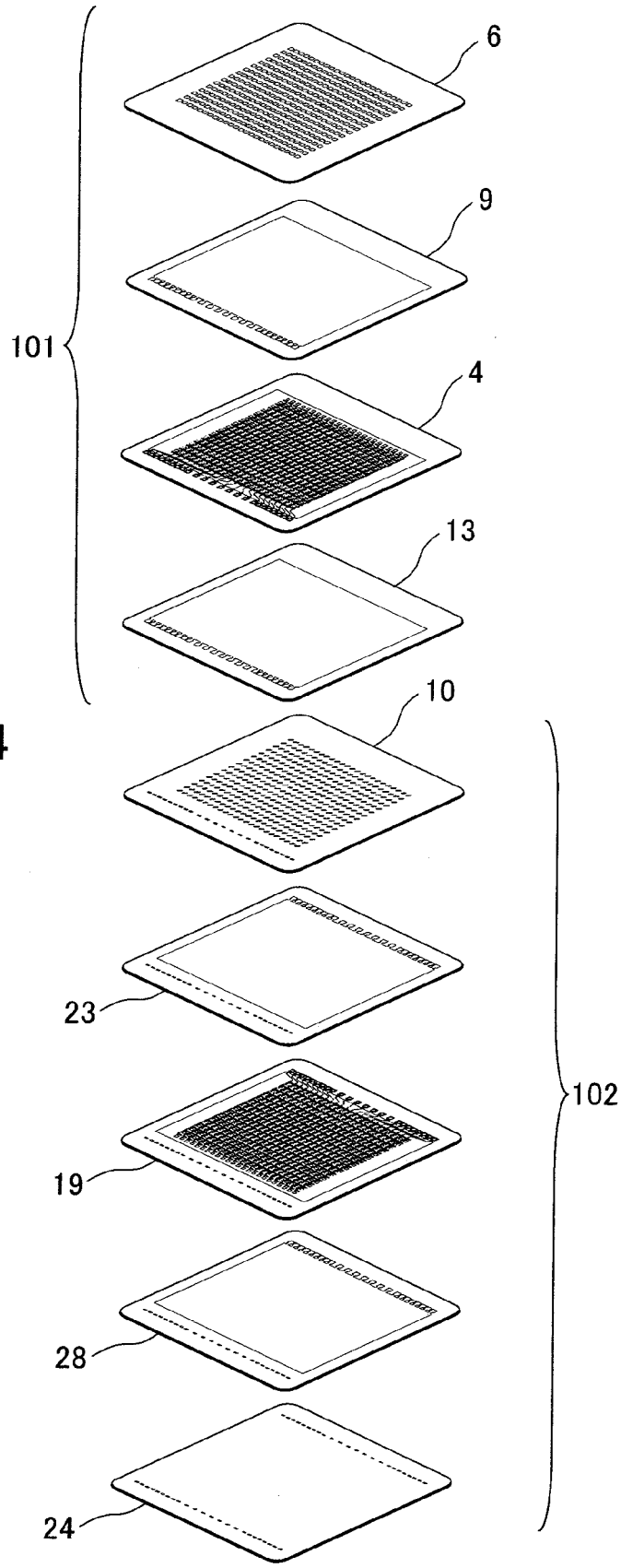
FIG. 14 is an explanatory diagram illustrating a second configuration of the multi-beam antenna device according to the present invention (third embodiment).
Figure 15:
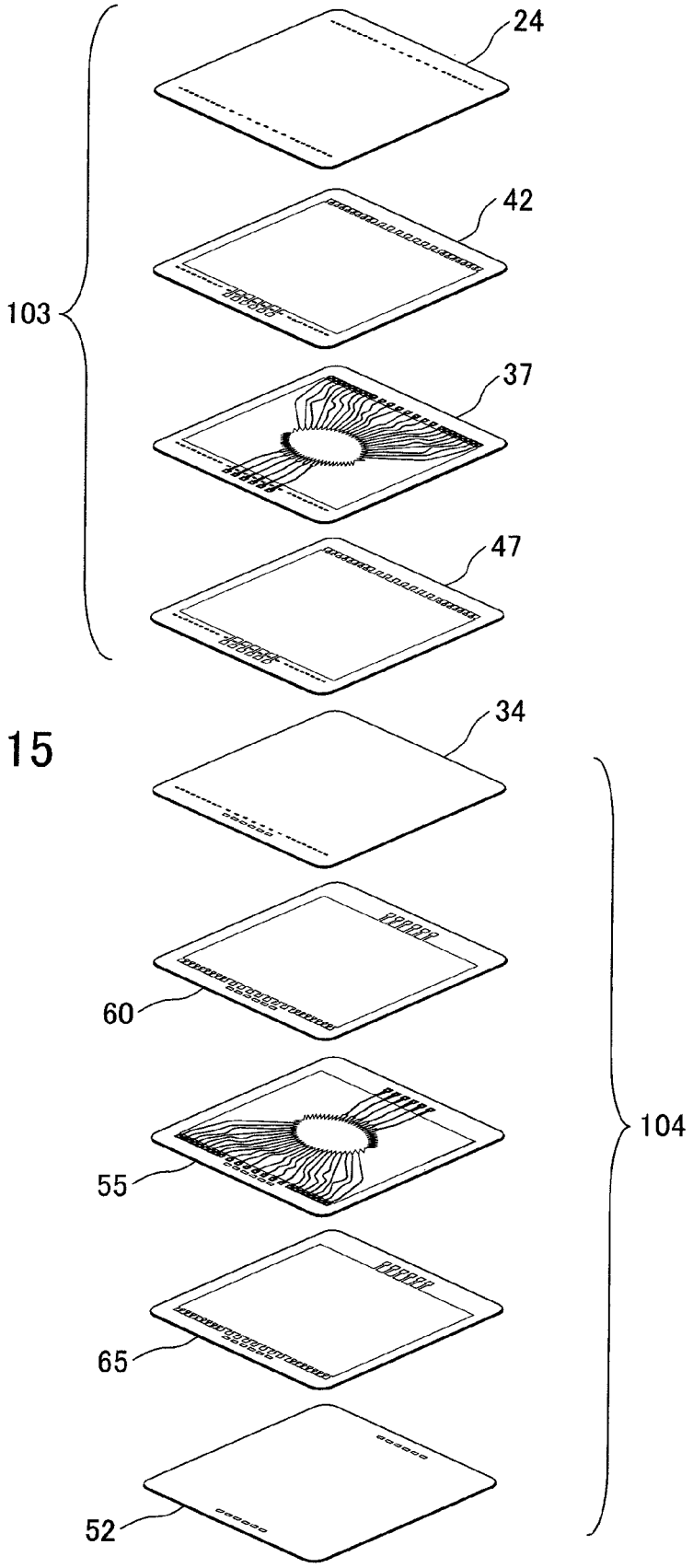
FIG. 15 is an explanatory diagram illustrating the second configuration of the multi-beam antenna device according to the present invention (third embodiment).

The above members were actually laminated in order as illustrated in FIGS. 14 and 15 to make up a multi-beam antenna device, and a measurement unit was connected to the multi-beam antenna device to measure characteristics thereof. As a result, a reflectance loss at a second or fifth waveguide opening portion (53, 66) corresponding to each of six input ports illustrated in FIG. 19 was equal to or less than −15 dB, and a gain directionality similar to that illustrated in FIG. 8 was obtained. Further, it could be ascertained that a beam of the array antenna (205) can be formed in a direction at an angle β which is about one-half of an input port angle α, as illustrated in Table 3. In this case, an insertion loss of the first or second Rotman lens (31, 49) having the size G=22.5 mm was about 2.5 dB.

TABLE 3

| Input Port No. | Input Port Angle α (degree) | Antenna Beam Angle β (degree) |
|---|---|---|
| 1 | 19 | 9.4 |
| 2 | 12 | 5.9 |
| 3 | 5 | 2.3 |
| 4 | −5 | −2.0 |
| 5 | −12 | −5.5 |
| 6 | −19 | −9.2 |

On the other hand, in a conventional Rotman lens designed in the following range: 1.137 Ln<G<1.42 Ln, while satisfying the condition of the Formula 5 under the defined condition of $\beta=\alpha$, i.e., $\eta=Ln/F<1$, it is at least necessary that G=1.137, Ln=10.5 λo, so that the size G of the conventional Rotman lens is set to a value which is about 10.5 times the free space wavelength (λo=3.95 mm) at a desired frequency of 76 GHz, i.e., to 41.5 mm. In this case, an insertion loss of the Rotman lens (1) was about 5 dB.

As above, the multi-beam antenna device according to the third embodiment is improved in relative gain by 2.5 dB or more, in comparison on the basis of a loss in a multi-beam antenna device formed by the conventional design process, so that it can achieve excellent characteristics, as with the embodiments 1 and 2.

In the multi-beam antenna device illustrated in FIGS. 1 and 2, the first connection portion of the first antenna substrate (4) and the fifth connection portion of the second Rotman lens substrate (55) are arranged to be electromagnetically coupled together, and the second connection portion of the second antenna substrate (19) and the third connection portion of the first Rotman lens substrate (37) are arranged to be electromagnetically coupled together. Alternatively, this multi-beam antenna device may be designed such that the first connection portion of the first antenna substrate (4) and the third connection portion of the first Rotman lens substrate (37) are arranged to be electromagnetically coupled together, and the second connection portion of the second antenna substrate (19) and the fifth connection portion of the second Rotman lens substrate (55) are arranged to be electromagnetically coupled together.

In the multi-beam antenna device illustrated in FIGS. 14 and 15, the first connection portion of the first antenna substrate (4) and the fifth connection portion of the second Rotman lens substrate (55) are arranged to be electromagnetically coupled together, and the second connection portion of the second antenna substrate (19) and the third connection portion of the first Rotman lens substrate (37) are arranged to be electromagnetically coupled together. Alternatively, this multi-beam antenna device may be designed such that the first connection portion of the first antenna substrate (4) and the third connection portion of the first Rotman lens substrate (37) are arranged to be electromagnetically coupled together, and the second connection portion of the second antenna substrate (19) and the fifth connection portion of the second Rotman lens substrate (55) are arranged to be electromagnetically coupled together.

The second embodiment is particularly useful as a vehicle-mounted antenna, and the second embodiment is usable as a wireless LAN transceiving antenna having a transmitting antenna and a receiving antenna in the form of a single antenna unit.

The following description will be added just to make sure. The seventh ground conductor 24 is redundantly illustrated between FIG. 1 and FIG. 2, between of FIG. 4 and FIG. 5, between FIG. 14 and FIG. 15, or between FIG. 17 and FIG. 18. However, it does not mean that the two same ground conductors 24 are formed in a two-layer structure. Such duplicate illustration is made only for the sake of facilitating explanation. Specifically, the seventh ground conductor 24 in FIG. 1 is the same component as the seventh ground conductor 24 in FIG. 2, and the seventh ground conductor 24 in FIG. 4 is the same component as the seventh ground conductor 24 in FIG. 5. The seventh ground conductor 24 in FIG. 14 is the same component as the seventh ground conductor 24 in FIG. 15, and the seventh ground conductor 24 in FIG. 17 is the same component as the seventh ground conductor 24 in FIG. 18.

The fourth ground conductor 10 is redundantly illustrated between FIG. 3 and FIG. 4 or between FIG. 16 and FIG. 17. However, it does not mean that the two same ground conductors 10 are formed in a two-layer structure. Such duplicate illustration is made only for the sake of facilitating explanation. Specifically, the fourth ground conductor 10 in FIG. 3 is the same component as the fourth ground conductor 10 in FIG. 4, and the fourth ground conductor 10 in FIG. 16 is the same component as the fourth ground conductor 10 in FIG. 17.

Figure 19:
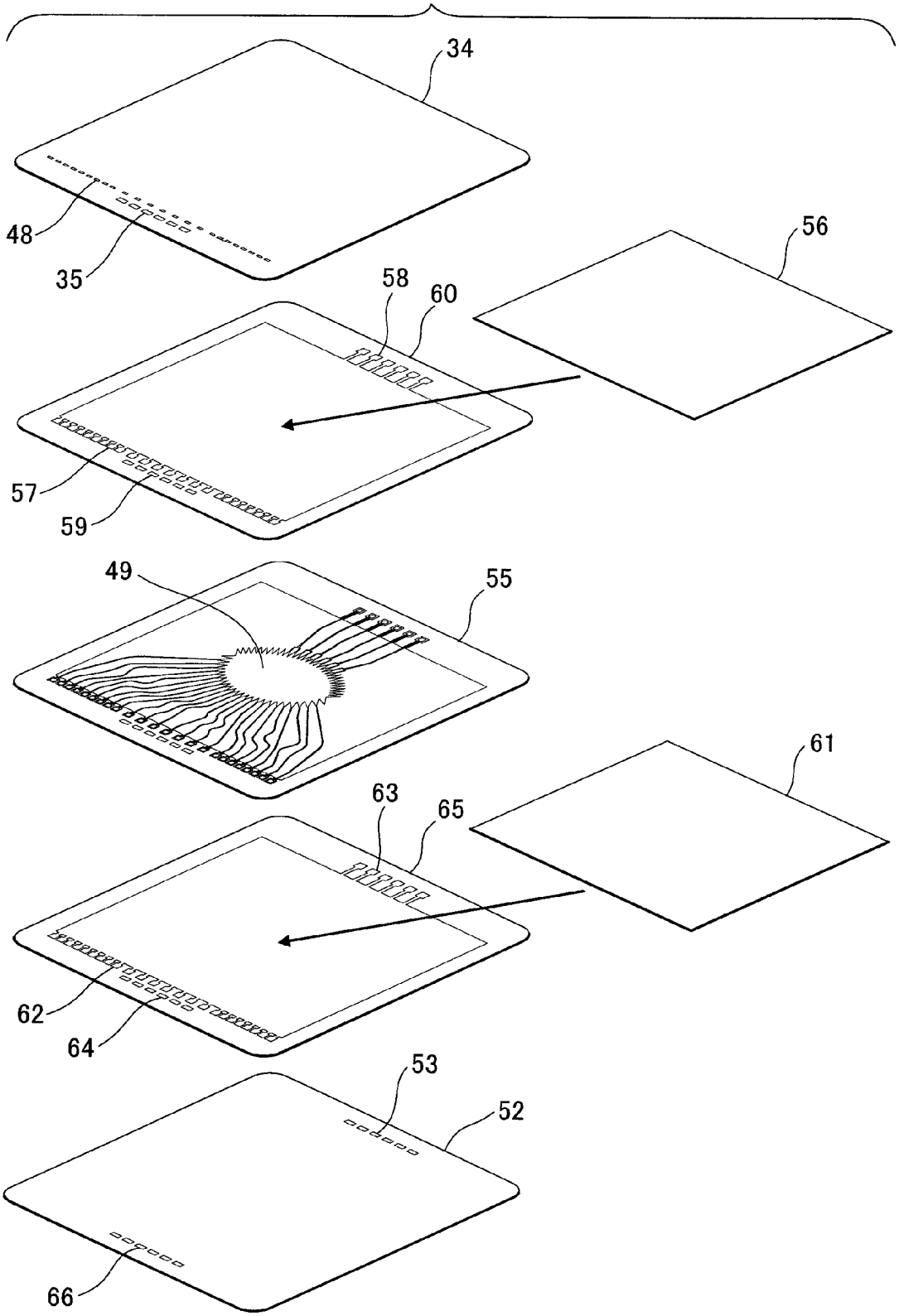
FIG. 19 is an explanatory diagram illustrating a second Rotman lens section in the second configuration of the multi-beam antenna device according to the present invention (third embodiment).

The tenth ground conductor 34 is redundantly illustrated between FIG. 5 and FIG. 6 or between FIG. 18 and FIG. 19. However, it does not mean that the two same ground conductors 34 are formed in a two-layer structure. Such duplicate illustration is made only for the sake of facilitating explanation. Specifically, the tenth ground conductor 34 in FIG. 5 is the same component as the tenth ground conductor 34 in FIG. 6, and the tenth ground conductor 34 in FIG. 18 is the same component as the tenth ground conductor 34 in FIG. 19.

EXPLANATION OF CODES

1: first radiation element
2: first feeder line
3: first connection portion
4: first antenna substrate
5: first slot
6: first ground conductor
7: first dielectric
8: first coupling hole-defining portion
9: second ground conductor
10: fourth ground conductor
11: second dielectric
12: second coupling hole-defining portion
13: third ground conductor
14: first slit
15: second slit
16: second radiation element
17: second feeder line
18: second connection portion
19: second antenna substrate
20: third dielectric
21: third coupling hole-defining portion
22: third slit
23: fifth ground conductor
24: seventh ground conductor
25: fourth ground conductor
26: fourth coupling hole-defining portion
27: fourth slit
28: sixth ground conductor
29: fifth slit
30: sixth slit
31: first Rotman lens
32: third feeder line
33: third connection portion
34: tenth ground conductor
35: first waveguide opening portion
36: fourth connection portion
37: first Rotman lens substrate
38: fifth dielectric
39: fifth coupling hole-defining portion
40: sixth coupling hole-defining portion
41: seventh slit
42: eighth ground conductor
43: sixth dielectric
44: seventh coupling hole-defining portion
45: eighth coupling hole-defining portion
46: eighth slit
47: ninth ground conductor
48: ninth slit
49: second Rotman lens
50: fourth feeder line
51: fifth connection portion
52: thirteenth ground conductor
53: second waveguide opening portion
54: sixth connection portion
55: second Rotman lens substrate
56: seventh dielectric
57: ninth coupling hole-defining portion
58: tenth coupling hole-defining portion
59: third waveguide opening portion
60: eleventh ground conductor
61: eighth dielectric
62: eleventh coupling hole-defining portion
63: twelfth coupling hole-defining portion
64: fourth waveguide opening portion
65: twelfth ground conductor
66: fifth waveguide opening portion
67: parasitic element
91: sixth connection portion
92: connection substrate

93: connection line with respect to system
94: thirteenth ground conductor
101: first antenna section
102: second antenna section
103: first Rotman lens section
104: second Rotman lens section
105: connection portion with respect to system
205: array antenna
207: feeder line section
208: center line of Rotman lens
209: auxiliary line indicating position of input port
210: bean direction with respect to a direction facing front of array antenna
221, 222, - - - , 22*m*: input port of Rotman lens
231, 232, - - - , 23*n*: output port of Rotman lens
241, 242, - - - , 24*n*: antenna element
261, 262, - - - , 26*n*: feeder line connecting output port and antenna element
701, 702, 703, 704, 705, 706: dielectric

The invention claimed is:

1. A multi-beam antenna device comprising a first antenna section, a second antenna section, a first Rotman lens section and a second Rotman lens section, which are laminated together in this order to form a planar antenna module, characterized in that:

the first antenna section includes a first antenna substrate, a first ground conductor, a second ground conductor, a third ground conductor and a fourth ground conductor, wherein:

the first antenna substrate has a plurality of first radiation elements and a plurality of first parasitic elements, which are located at positions corresponding to respective ones of a plurality of second radiation elements of the second antenna section, in such a manner that a plurality of antenna groups is formed therein in combination with a first feeder line connected to the first radiation elements and a first connection portion electromagnetically coupled to the second Rotman lens section;

the first ground conductor has a plurality of first slots located at positions corresponding to respective ones of the first radiation elements and the first parasitic elements;

the second ground conductor has a first dielectric located between the first antenna substrate and the first ground conductor, and a first coupling hole-defining portion located at a position corresponding to the first connection portion;

the third ground conductor has a second dielectric located between the first antenna substrate and the fourth ground conductor, and a second coupling hole-defining portion located at a position corresponding to the first connection portion; and the fourth ground conductor has a first slit located at a position corresponding to the first connection portion, and a plurality of second slits located at positions corresponding to the respective ones of the first radiation elements and the first parasitic elements;

the second antenna section includes a second antenna substrate, the fourth ground conductor, a fifth ground conductor, a sixth ground conductor and a seventh ground conductor, wherein:

the second antenna substrate has a plurality of antenna groups formed in combination with a second feeder line connected to the second radiation elements and a second connection portion electromagnetically coupled to the first Rotman lens section;

the fifth ground conductor has a third dielectric located between the second antenna substrate and the fourth ground conductor, a third coupling hole-defining portion located at a position corresponding to the second connection portion, and a third slit located at a position corresponding to the first connection portion;

the sixth ground conductor has a fourth dielectric located between the second antenna substrate and the seventh ground conductor, a fourth coupling hole-defining portion located at a position corresponding to the second connection portion, and a fourth slit located at a position corresponding to the first connection portion; and the seventh ground conductor has a fifth slit located at a position corresponding to the second connection portion, and a sixth slit located at positions corresponding to the first connection portion;

the first Rotman lens section includes a first Rotman lens substrate, the seventh ground conductor, an eighth ground conductor, a ninth ground conductor and a tenth ground conductor, wherein:

the first Rotman lens substrate has a first Rotman lens, a third feeder line, a third connection portion electromagnetically coupled to the second connection portion of the second antenna section, and a fourth connection portion electromagnetically coupled to a first waveguide opening portion of the tenth ground conductor;

the eighth ground conductor has a fifth dielectric located between the first Rotman lens substrate and the seventh ground conductor, a fifth coupling hole-defining portion located at a position corresponding to the third connection portion, a sixth coupling hole-defining portion located at a position corresponding to the fourth connection portion, and a seventh slit located at a position corresponding to the first connection portion;

the ninth ground conductor has a sixth dielectric located between the first Rotman lens substrate and the tenth ground conductor, a seventh coupling hole-defining portion located at a position corresponding to the third connection portion, an eighth coupling hole-defining portion located at a position corresponding to the fourth connection portion, and an eighth slit located at a position corresponding to the first connection portion; and the tenth ground conductor has the first waveguide opening portionlocated at a position corresponding to the fourth connection portion, and a ninth slit located at a position corresponding to the first connection portion; and the second Rotman lens section includes a second Rotman lens substrate, the tenth ground conductor, an eleventh ground conductor, a twelfth ground conductor and a thirteenth ground conductor, wherein:

the second Rotman lens substrate has a second Rotman lens, a fourth feeder line, a fifth connection portion electromagnetically coupled to the first connection portion of the first antenna section, and a sixth connection portion electromagnetically coupled to a second waveguide opening portion of the thirteenth ground conductor;

the eleventh ground conductor has a seventh dielectric located between the second Rotman lens substrate and the tenth ground conductor, a ninth coupling hole-defining portion located at a position corresponding to the fifth connection portion, a tenth coupling hole-defining portion located at a position corresponding to the sixth connection portion, and a third waveguide opening portion located at a position corresponding to the fourth connection portion;

the twelfth ground conductor has an eighth dielectric located between the second Rotman lens substrate and the thirteenth ground conductor, an eleventh coupling hole-defining portion located at a position corresponding to the fifth connection portion, a twelfth coupling hole-defining portion located at a position corresponding to the sixth connection portion, and a fourth waveguide opening portion located at a position corresponding to the fourth connection portion; and the thirteenth ground conductor has the second waveguide opening portion located at a position corresponding to the sixth connection portion, and a fifth waveguide opening portion located at a position corresponding to the fourth connection portion, wherein the first ground conductor, the second ground conductor with the first dielectric, the first antenna substrate, the third ground conductor with the second dielectric, the fourth ground conductor, the fifth ground conductor with the third dielectric, the second antenna substrate, the sixth ground conductor with the fourth dielectric, the seventh ground conductor, the eighth ground conductor with the fifth dielectric, the first Rotman lens substrate, the ninth ground conductor with the sixth dielectric, the tenth ground conductor, the eleventh ground conductor with the seventh dielectric, the second Rotman lens substrate, the twelfth ground conductor with the eighth dielectric, and the thirteenth ground conductor, are laminated together in this order.

2. The multi-beam antenna device as defined in claim 1, characterized in that at least one of the first to ninth slits is formed as a slot.

3. The multi-beam antenna device as defined in claim 1 or 2, characterized in that each of the first and second Rotman lenses is provided with a plurality of input ports for feeding electric power, and a plurality of output ports for extracting the electric power from the input ports, and associated with an array antenna comprised of a plurality of antenna elements and adapted to radiate electromagnetic waves to space, and a plurality of feeder lines connecting respective ones of the output ports to respective ones of the antenna elements, wherein a curve for arranging the output ports thereon and a length of each of the feeder lines are set such that, when a given one of the input ports is excited, a beam is formed in a direction at an angle corresponding to that of the given input port, and wherein:

$\beta$with respect to $\alpha$ is set to satisfy the following relation: $\beta<\alpha$, where: $\beta$is a spatial beam-forming angle of the array antenna when viewed from a direction facing a front of the array antenna; and a is an angle between a center line of the Rotman lens, and a line segment which connects one of the input ports and an intersecting point S2 of the center line with a curve segment having the output ports arranged thereon; and a shape of the Rotman lens is set to satisfy the following relation:

$\eta=(\beta/\alpha)(Ln/F)<1$, and reduce G to less than a value of G when designed under a condition of $\beta=\alpha$, where: F is a distance between the one input port and S2; 2 Ln is an aperture length of the array antenna; and G is a size of the Rotman lens, and defined as a distance between S2 and S3, wherein S3 is an intersecting point of the center line with a curve segment having the input ports arranged thereon.

* * * * *